US007014306B2

(12) United States Patent
Netsu et al.

(10) Patent No.: US 7,014,306 B2
(45) Date of Patent: Mar. 21, 2006

(54) LIQUID RESERVOIR APPARATUS

(75) Inventors: Hiroshi Netsu, Kanagawa (JP); Junji Shimoda, Kanagawa (JP); Toshihiko Ujita, Kanagawa (JP); Hideaki Okamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 156 days.

(21) Appl. No.: 10/714,652

(22) Filed: Nov. 18, 2003

(65) Prior Publication Data

US 2004/0135853 A1 Jul. 15, 2004

(30) Foreign Application Priority Data

Nov. 20, 2002 (JP) ..... 2002-336459

(51) Int. Cl.
*B41J 2/175* (2006.01)

(52) U.S. Cl. ..... 347/86

(58) Field of Classification Search ..... 347/84–87, 347/31

See application file for complete search history.

(56) References Cited

U.S. PATENT DOCUMENTS

| | | | | |
|---|---|---|---|---|
| 4,313,124 A | 1/1982 | Hara | ..... | 346/140 R |
| 4,345,262 A | 8/1982 | Shirato et al. | ..... | 346/140 R |
| 4,459,600 A | 7/1984 | Sato et al. | ..... | 346/140 R |
| 4,463,359 A | 7/1984 | Ayata et al. | ..... | 346/1.1 |
| 4,558,333 A | 12/1985 | Sugitani et al. | ..... | 346/140 R |
| 4,723,129 A | 2/1988 | Endo et al. | ..... | 346/1.1 |
| 4,740,796 A | 4/1988 | Endo et al. | ..... | 346/1.1 |
| 5,430,471 A | 7/1995 | Nakajima et al. | ..... | 347/87 |
| 2002/0075366 A1 * | 6/2002 | Smith et al. | ..... | 347/86 |
| 2003/0160848 A1 | 8/2003 | Taniguchi et al. | ..... | 347/86 |

FOREIGN PATENT DOCUMENTS

| | | |
|---|---|---|
| DE | 196 03 195 | 7/1997 |
| EP | 408978 | 1/1991 |
| EP | 1048468 | 11/2000 |
| JP | 59-138461 | 8/1984 |
| JP | 59-123670 | 7/1985 |
| JP | 3-139562 | 6/1991 |
| JP | 4-179553 | 6/1992 |
| JP | 2001-1682 | 1/2001 |

* cited by examiner

*Primary Examiner*—K. Feggins
(74) *Attorney, Agent, or Firm*—Fitzpatrick, Cella, Harper & Scinto

(57) ABSTRACT

An ink reservoir (166) has a plurality of thin bodies (164) provided in a housing (161) at gaps from each other. Ink in the housing (161) is held by a capillary force generated by the thin bodies (164). An ink guide portion (167) which is set at a gap between one end of the liquid ink (166) and an inner wall of the housing (161) is provided so that a capillary force in the vicinity of an ink supply port (165) is larger than that of the liquid reservoir (166).

10 Claims, 22 Drawing Sheets

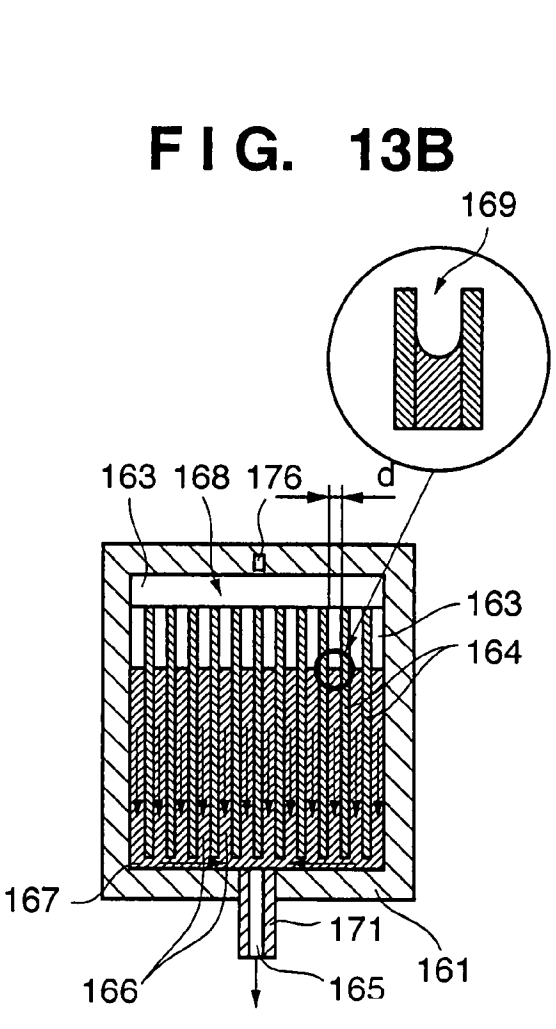
FIG. 13B
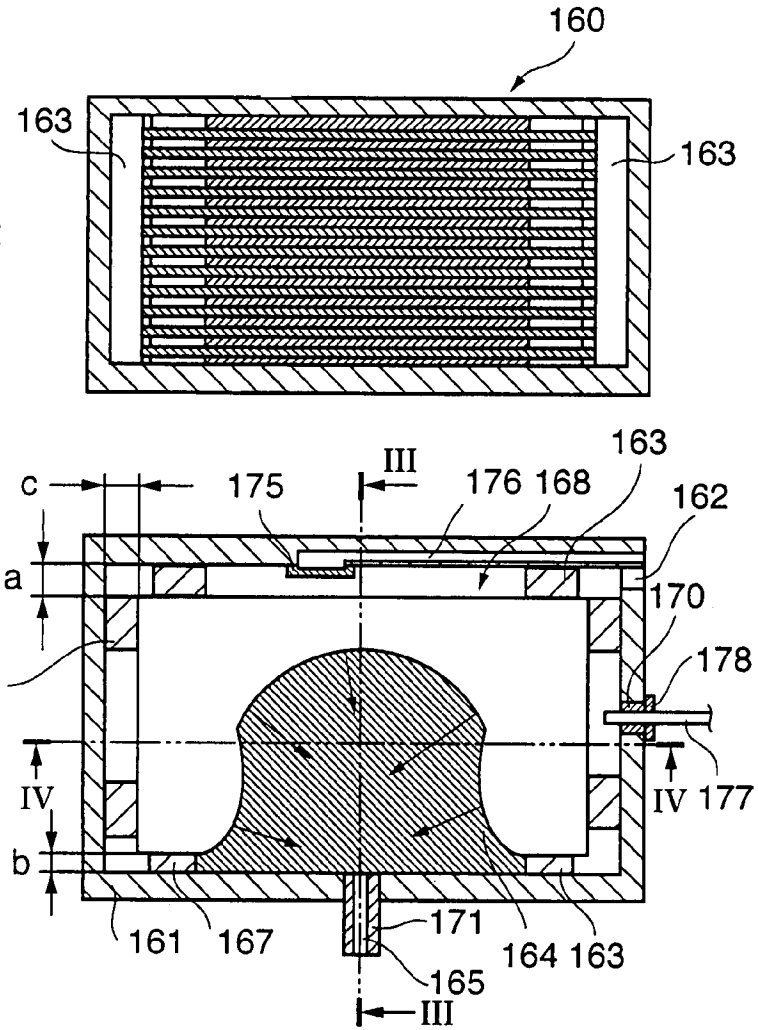
FIG. 13C
FIG. 13A

LIQUID RESERVOIR APPARATUS

FIELD OF THE INVENTION

The present invention relates to a liquid reservoir apparatus provided to a printer that prints by discharging ink onto, e.g., a printing sheet and, more particularly, to a liquid reservoir apparatus which uses a gas/liquid separating member for supplying a liquid such as ink.

BACKGROUND OF THE INVENTION

Conventionally, as an inkjet printer, one having an inkjet printhead which discharges ink droplets, a main tank which stores ink to be supplied to the ink-jet printhead, and a subtank which holds the ink supplied from the main tank is known.

In an inkjet printer of this type, many ink supply mechanisms which supply ink to the ink-jet printheads have been proposed and put into practical use. To supply the ink to the inkjet printhead, the capillary force of the nozzle itself of the ink-jet printhead is utilized, and accordingly no external force of a pump or the like is usually required. Therefore, a mechanism which supplies ink with a pressure from a subtank (reservoir ink tank) to the inkjet printhead is not required except for a special case. To cause ink droplets to stably fly from the nozzle of the inkjet printhead, a very low negative pressure of (−) 30 [Pa] to (−) 2,000 [Pa] must be applied. This is a significant issue in designing the inkjet printer.

To realize this, many attempts have been made to provide a negative pressure generating mechanism to an ink reservoir apparatus having a reservoir ink tank. The structure of a conventional ink reservoir apparatus will be described with reference to the accompanying drawings.

FIG. 19 is a schematic view of the structure of an ink reservoir apparatus employing a spring bag scheme. As shown in FIG. 19, in this ink reservoir apparatus, a coil spring 222 is arranged in a bag 221 which stores ink 223 in order to generate a negative pressure. The elastic force of the coil spring 222 made of a metal or the like applies an expansion force that expands the bag 221 in directions of arrows $S_1$ and $S_2$, so that the ink 223 generates a negative pressure. In this ink reservoir apparatus, the ink 223 is supplied from a supply port 224 formed in the bag 221.

FIG. 20 is a schematic view of the structure of an ink reservoir apparatus employing a regulating-valve-added bag scheme. As shown in FIG. 20, in this ink reservoir apparatus, a pressure regulating valve 231 is provided to a housing 230 which covers a bag 221 storing ink 223. The pressure regulating valve 231 causes external air 233 to flow into the housing 230, to control the pressure caused by inner air 232 outside the bag 221, so that a negative pressure is generated in the ink 223 in the bag 221. As in these ink reservoir apparatuses, when the internal pressure of the soft, flexible bag 221 is to be controlled with some mechanism, generally, the number of components increases and the manufacturing cost increases. It is also technically difficult to manage generation of a negative pressure of about several hundred Pa. If a negative pressure generating mechanism is provided, the ability to hold ink that can be used may decrease. Furthermore, when the bag is thin, it has poor hermeticity. When ink is stored in the thin bag over a long period of time, the external air may enter the bag to expand it, or the ink in the bag may evaporate. Therefore, when a mechanism that generates a negative pressure is to be added to an ink reservoir apparatus using a bag while ensuring the reliability, many problems must be solved.

FIG. 21 is a schematic view of the structure of a currently mainstream ink reservoir apparatus employing sponge. As shown in FIG. 21, in this ink reservoir apparatus, a sponge 241 is arranged in a housing 240 having a vent hole 242 and supply port 243. The sponge 241 can hold ink with the capillary force of itself. Thus, a desired negative pressure can be ensured by only selecting the density of the sponge. This ink reservoir apparatus has a very simple structure and can be manufactured at a comparatively low cost if a commercially available sponge is used. This ink reservoir apparatus can be downsized. A negative pressure is generated regardless of a difference in posture of the ink reservoir apparatus.

A sponge manufactured by a general sponge manufacturing method, however, does not have a sufficiently high density, and must be used after it is compressed to a certain degree. Consequently, with the sponge scheme, the use efficiency of the ink of the sponge degrades, and generally the sponge can be filled with the ink to as low as about 70% the sponge volume.

Generally, when that portion of an inkjet printer with which the ink comes into contact is to be made of a metal, it is made of stainless steel, and when it is to be made of a resin material, it is made of polypropylene, polyethylene, a fluoroplastic, or the like. When the ink contact portion comes into contact with the ink, a trace amount of decomposed material or additive sometimes elutes to the ink. A commercially available sponge is often made of a urethane resin and has a comparatively low chemical stability. For this reason, in recent years, a sponge made of polypropylene which is chemically more stable has been employed.

Since a porous body such as a sponge comes into contact with the ink with a large area, it may chemically react with the ink, or its additional matter may dissolve in the ink. Then, a large amount of product produced from the ink often adversely affects a portion in the vicinity of the nozzle. Various types of ink are used to expand the use of the ink-jet printer, but the chemical stability of the sponge poses an issue. Accordingly, the composition of the ink must often be unavoidably changed to improve the chemical stability, while the physical characteristics are degraded.

Furthermore, an ink holding body manufactured by compressing a urethane resin sponge, as described above, or polypropylene or polyethylene fiber has a comparatively large compression distribution. When such an ink holding body is repeatedly refilled with the ink, its compression structure includes air bubbles, and its ink filling rate gradually decreases. This phenomenon is caused due to the following reason. When refilling the ink, the ink is filled in the dense portion of the ink holding body first because the dense portion has a comparatively large capillary force, while the ink is not filled in the sparse portion of the ink holding body. Consequently, air bubbles are left in the sparse portion to form air bubbles. Once air bubbles are generated, they tend to remain as they are even after the ink is drawn out. As refill is repeated, the size and number of air bubbles increase and the filling rate decreases.

FIG. 22 shows another arrangement having the same function as that of the sponge which serves to hold the ink and to generate the negative pressure. FIG. 22 shows an arrangement in which, in place of a porous body such as a sponge, a plurality of thin plates 251 provided in a housing 250 at gaps hold ink. The narrow gaps between the thin plates 251 are utilized as an ink reservoir 253 (for example, see Japanese Patent Laid-Open Nos. 4-179553 and 3-139562). In this arrangement, the ink reservoir 253 holds the ink and generates a negative pressure with the capillary force which is expressed by a classic expression $h=2T\cos\theta/\rho gr$. In this manner, an ink reservoir apparatus using the plurality of multilayered thin plates 251 has a comparatively simple structure and enables reliable size management that does not depend on a manufacturing method as with the sponge.

To extract the ink from the ink reservoir 253 reliably, however, another capillary body 255 must be arranged to desirably extend through the respective multilayered thin plates 251. The capillary body 255 must have a larger capillary force than that of the ink reservoir 253, resulting in an excessively large ink channel resistance. Therefore, when this ink reservoir apparatus is applied to a high-frequency inkjet printer which consumes a particularly large mount of ink and has many nozzles, while the ink is supplied, the dynamic resistance increases. Accordingly, sometimes the ink is not discharged from a supply port 252.

As described above, in the inkjet printer, an ink reservoir apparatus is sought for which is manufactured at an inexpensive cost, which is chemically stable against ink, which generates a negative pressure with a low ink channel resistance regardless of a difference in posture of the reservoir ink tank, and which supplies the ink to the inkjet printer stably.

In particular, in an inkjet printer which prints while refilling with ink a subtank which temporarily holds ink supplied from a main tank, as refill is repeated, the filling rate of the ink that can be refilled in the subtank decreases. This phenomenon is a critical problem.

SUMMARY OF THE INVENTION

It is, therefore, an object of the present invention to provide a liquid reservoir apparatus which can ensure a chemical stability against a liquid with an arrangement that can be manufactured at a comparatively low cost, can generate a negative pressure with a low ink channel resistance regardless of a difference in posture of the liquid tank, and can supply the liquid stably.

In order to achieve the above object, the present invention includes the following various aspects.

(1) A liquid reservoir apparatus according to the present invention comprises a liquid tank having a storage which stores a liquid, a negative pressure introducing portion which introduces a negative pressure into the storage, a liquid intake portion which takes the liquid into the storage with the negative pressure introduced from the negative pressure introducing portion, a liquid reservoir which is provided in the storage to hold the liquid stored in the storage, a liquid supply port which is provided to the storage to supply the liquid stored in the storage, and a gas/liquid separating member which is provided to the negative pressure introducing portion to transmit only a gas therethrough, and negative pressure generating means which draws air in the storage by suction to effect the negative pressure.

The liquid reservoir has a plurality of thin bodies provided at gaps from each other in the storage, so that the liquid in the storage is held by a capillary force generated by the thin bodies. A liquid guide portion, which is set at a gap between one end of the liquid reservoir and an inner wall of the storage, is provided so that the capillary force in the vicinity of the liquid supply port is larger than that of the liquid reservoir.

With the liquid reservoir apparatus having the above arrangement according to the present invention, the gaps across which the plurality of thin bodies oppose without abutting against each other serve as the liquid reservoir. The liquid held by the liquid reservoir is held by the capillary force of the liquid itself. With the liquid reservoir apparatus according to the present invention, as the liquid guide portion sets the capillary force in the vicinity of the liquid supply port to be larger than that of the liquid reservoir, the liquid held by the liquid reservoir is supplied from the liquid supply port to, e.g., a liquid discharge head. With the liquid reservoir apparatus according to the present invention, the liquid is held by only the plurality of thin bodies, and the liquid is supplied well. Accordingly, the chemical stability against the liquid is ensured with an arrangement that can be manufactured at a comparatively low cost. A negative pressure can be generated with a low channel resistance regardless of a difference in posture of the liquid tank. Thus, the liquid can be supplied stably.

(2) A liquid reservoir apparatus according to the present invention comprises a liquid tank having a storage which stores a liquid, a negative pressure introducing portion which introduces a negative pressure into the storage, a liquid intake portion which takes the liquid into the storage with the negative pressure introduced from the negative pressure introducing portion, a liquid reservoir which is provided in the storage to hold the liquid stored in the storage, and a liquid supply port which is provided to the storage to supply the liquid stored in the storage, and a negative pressure generating means which has a gas/liquid separating member provided at a position opposing the negative pressure introducing portion to transmit only a gas through it, and draws air in the storage by suction to effect the negative pressure. The liquid reservoir has a plurality of thin bodies provided at gaps from each other in the storage, so that the liquid in the storage is held by a capillary force generated by the thin bodies. A liquid guide portion which is set at a gap between one end of the liquid reservoir and an inner wall of the storage is provided so that the capillary force in the vicinity of the liquid supply port is larger than that of the liquid reservoir.

(3) The liquid reservoir apparatus according to any one of (1) and (2), wherein the inner wall of the storage has a groove, at a position adjacent to the liquid introducing portion, which generates a capillary force larger than that of the liquid introducing portion.

(4) The liquid reservoir apparatus according to any one of (1) to (3), wherein the gaps among the thin bodies in the liquid reservoir gradually increase as the gaps are more distant from the liquid introducing portion increase.

(5) The liquid reservoir apparatus according to any one of (1) to (4), wherein the gaps among the thin bodies in the liquid reservoir fall within a range of 0.05 mm (inclusive) to 0.5 mm (inclusive).

(6) The liquid reservoir apparatus according to any one of (1) to (5), wherein the capillary force of the liquid reservoir falls within a range of 30 Pa (inclusive) to 2,000 Pa (inclusive).

(7) The liquid reservoir apparatus according to any one of (1) to (6), wherein the gas/liquid separating member is porous.

(8) The liquid reservoir apparatus according to any one of (1) to (6), wherein the gas/liquid separating member is a gas permeable film made of a porous material.

(9) The liquid reservoir apparatus according to any one of (1) to (6), wherein the gas/liquid separating member is a gas permeable film made of a porous resin material. As the porous resin material, for example, PTFE (polytetrafluoroethylene) or a material similar to it can be named.

(10) The liquid reservoir apparatus according to any one of (7) to (9), wherein the gas/liquid separating member is subjected to a repellent treatment.

(11) A printer comprising a liquid reservoir apparatus according to any one of (1) to (10), wherein the printer prints by discharging ink through a printhead.

As described above, the liquid reservoir apparatus according to the present invention has a liquid reservoir which has a plurality of thin bodies provided at gaps from each other in a storage, and a liquid introducing portion set at a gap between one end of the liquid reservoir and an inner wall of the storage such that a capillary force in the vicinity of a liquid supply port is larger than that of the liquid reservoir. Therefore, chemical stability against the liquid is obtained with an arrangement that can be manufactured at a comparatively low cost. A negative pressure can be generated with a low ink channel resistance regardless of a difference in posture of the liquid tank. Thus, the liquid can be supplied stably.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

FIGS. 12A, 12B, and 12C are views for explaining an ink reservoir according to the first embodiment, in which FIG. 12A is a sectional front view seen from the front, FIG. 12B is a sectional view taken along the line I—I of FIG. 12A, and FIG. 12C is a sectional view taken along the line II—II of FIG. 12A;

FIGS. 13A, 13B, and 13C are views for describing how ink flows in the ink reservoir, in which FIG. 13A is a sectional front view seen from the front, FIG. 13B is a sectional view taken along the line III—III of FIG. 13A, and FIG. 13C is a sectional view taken along the line IV—IV of FIG. 13A;

FIGS. 14A, 14B, and 14C are views for explaining an ink reservoir according to the second embodiment, in which FIG. 14A is a sectional front view seen from the front, FIG. 14B is a sectional view taken along the line V—V of FIG. 14A, and FIG. 14C is a sectional view taken along the line VI—VI of FIG. 14A;

FIGS. 15A, 15B, and 15C are views for explaining thick bodies constituting the ink reservoir, in which FIG. 15A is a front view, FIG. 15B is a plan view, and FIG. 15C is a side view;

FIGS. 17A and 17B are views for explaining an ink reservoir according to the third embodiment, in which FIG. 17A is a sectional front view seen from the front, and FIG. 17B is a sectional view taken along the line VIII—VIII of FIG. 17A;

DETAILED DESCRIPTION OF THE PREFERRED EMBODIMENTS

The practical embodiments of the present invention will be described with reference to the accompanying drawings.

First Embodiment

Figure 1:
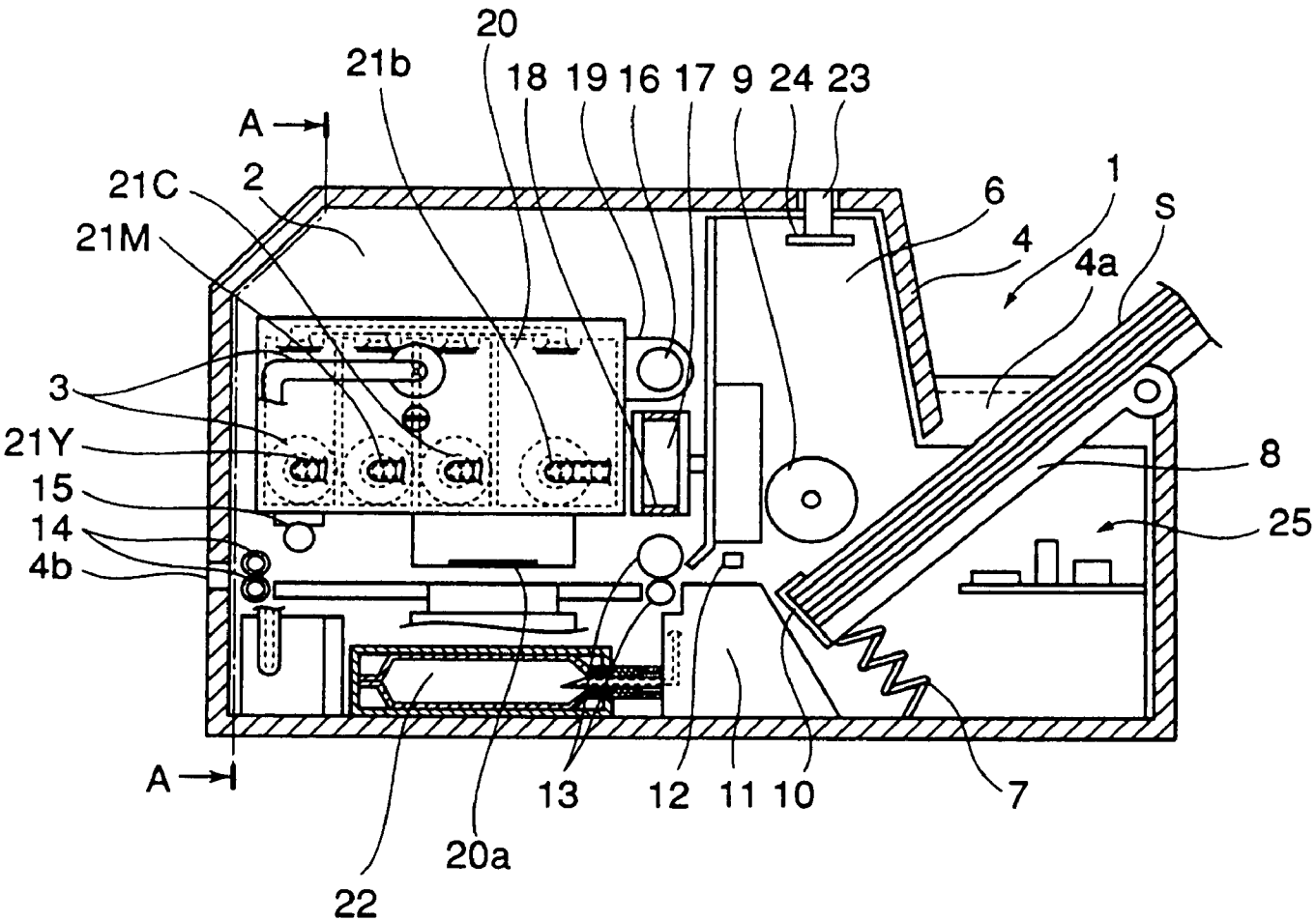
FIG. 1 is a sectional view showing a serial type inkjet printer according to the present invention.
Figure 2:
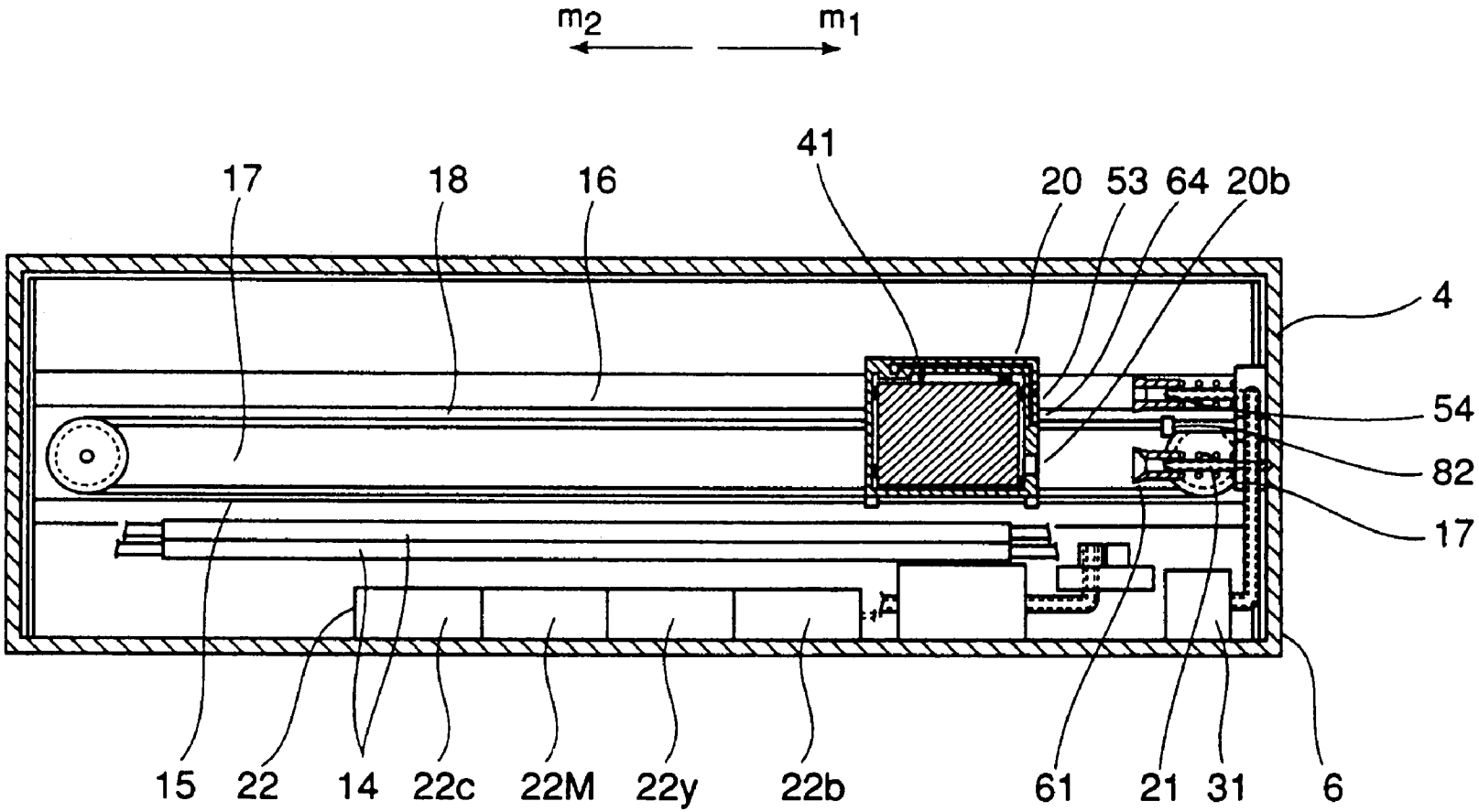
FIG. 2 is a sectional view taken along the line A—A of FIG. 1 to show the inkjet printer.

FIGS. 1 and 2 are sectional views showing the schematic structure of an inkjet printer according to this embodiment. The inkjet printer of this embodiment employs a serial scan scheme with which the inkjet head moves in the main scanning direction.

As shown in FIG. 1, the inkjet printer (to be simply referred to as a printer hereinafter) has a feed section 1 which feeds a printing medium S, a printing section 2 which discharges ink onto the printing medium S to print a character, an image, or the like, an ink replenishing section 3 which replenishes the ink, and a cover 4 which forms an outer housing.

The cover 4 has an insert port 4*a* through which the printing medium S is inserted and a discharge port 4*b* through which the printing medium S is discharged. An image or the like is printed on the printing medium S inserted from the insert port 4*a* with the printing section 2, and the printing medium S is discharged from the discharge port 4*b*.

The feed section 1 has, inside a side plate 6 provided inside the cover 4, a carrier 8 which places a plurality of printing media S on it, a feed roller 9 which feeds the printing medium S, and a guide member 11. The carrier 8 is biased by the elastic force of a coil spring 7 toward the feed roller 9 arranged above the carrier 8. The feed roller 9 abuts against the printing medium S located at the highest position among the plurality of printing media S placed on the carrier 8. The guide member 11 guides one printing medium S separated by a separation mechanism 10 toward the printing section 2. Above the feed path of the printing medium S, a photosensor 12 which detects the printing medium S passing downstream of the guide member 11 is provided.

The printer also has a pair of convey rollers 13 which convey the printing medium S fed from the feed section 1 at a constant speed, and a pair of unloading rollers 14 which unload the printing medium S on which an image or the like is printed.

As shown in FIGS. 1 and 2, the printing section 2 has a printhead 20*a* which discharges the ink onto the printing medium S, a reservoir ink tank 20 which supplies the ink to the printhead 20*a*, and a carriage 19 which holds the printhead 20*a* and reservoir ink tank 20.

The carriage 19 is movably guided by guide shafts 15 and 16 in the main scanning direction (widthwise direction of the printing medium S) which corresponds to the directions of arrows $m_1$ and $m_2$ in FIG. 2. The carriage 19 is moved in the main scanning direction by a driving force transferred from a carriage motor (not shown) through a belt 18 extending between a pair of pulleys 17. The reservoir ink tank 20 is detachably mounted on the carriage 19. The printhead 20*a* discharges the ink supplied from the reservoir ink tank 20 on the basis of print information such as an image.

The reservoir ink tank 20 has an ink reservoir which holds the ink. The arrangement of the ink reservoir will be described later.

The printer according to this embodiment has a head cartridge in which the reservoir ink tank 20 and printhead 20*a* are integrally connected. The reservoir ink tank 20 and printhead 20*a* may be formed separately and be detachably connected. Alternatively, the reservoir ink tank 20 and printhead 20*a* may be separately mounted on the carriage 19. As shown in FIG. 1, the printer has an electrical wiring board 24 arranged inside the cover 4. A plurality of operation buttons 23 are provided to project from the outer surface of the cover 4 through the cover 4. The printer also has a control circuit portion 25 which controls the printer through communication with the host computer. The control circuit portion 25 has a control electrical wiring board arranged inside the cover 4. A microcomputer, memory, and the like are mounted on the control electrical wiring board.

Figure 6:
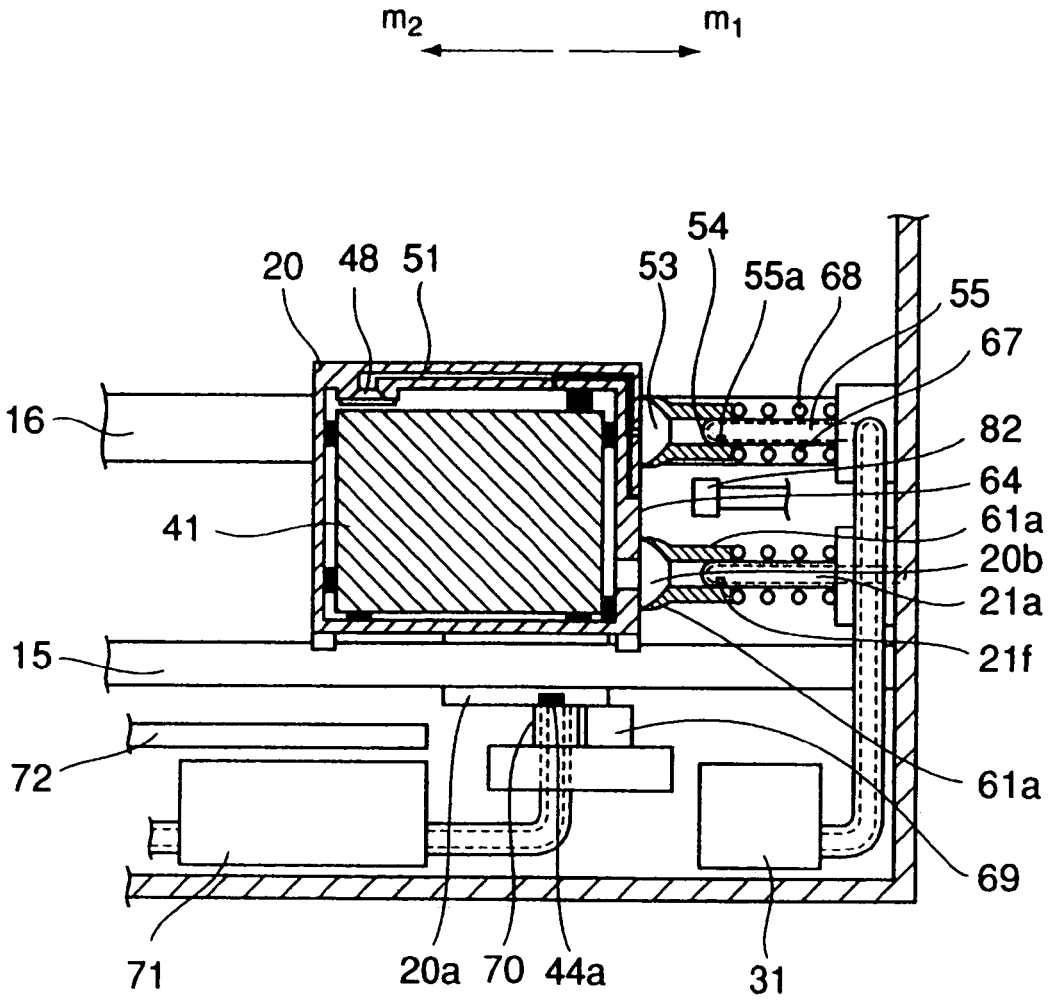
FIG. 6 is a longitudinal sectional view showing a state of power OFF or waiting of the inkjet printer.

As shown in FIG. 6, cap members 61 and 54 which are biased by coil springs 67 and 68 in the direction of an arrow $m_2$ are slidably fitted on the surfaces of pipe 21*a* and conduit 55, respectively, which are provided to the printer. The pipe 21*a* and conduit 55 have communication holes 21*f* and 55*a* opened/closed by the cap members 61 and 54, respectively. The pipe 21*a* and conduit 55 have closed distal ends, and their proximal ends are connected to the replenish ink tank 22 shown in FIG. 1. A vertically movable replenishing cap member 69 and recovery processing cap member 70 are provided in the printer. The recovery processing cap member 70 is connected to a waste liquid container (not shown) through a recovery processing suction pump 71. A platen 72 which guides the printing medium S is provided, on the convey path of the printing medium S, at a position for printing the image or the like with the printhead 20*a*.

FIG. 6 shows a state wherein the printhead 20*a* has moved to its home position and the power supply of the printer is OFF. In this state, the cap members 69 and 70 move upward, and the recovery processing cap member 70 seals an orifice surface 44*a* of the printhead 20*a*. In this case, the supply cap member 61 closes an ink intake port 20*b* while it closes the communication hole 21*f* of the pipe 21*a*. At the same time, the supply cap member 61 is at a position not closing a vent hole 64. Hence, in this state, air can be introduced and discharged between the interior and outside of the reservoir ink tank 20 in accordance with the pressure fluctuations in the reservoir ink tank 20 which are caused by a change in ambient temperature. The cap member 54 closes a common suction port 53 while it closes the communication hole 55*a* of the conduit 55. The ink discharge state of the printhead 20*a* at the home position can be maintained well by a head discharge recovery process (to be merely abbreviated as recovery process hereinafter) of discharging ink not contributing to image printing. The recovery process includes a process of introducing the negative pressure generated by the recovery processing suction pump 71 into the recovery processing cap member 70 to forcibly draw by suction and discharge the ink from an orifice 44 of the printhead 20*a*, a process of discharging the ink from the orifice 44 into the recovery process cap member 70, and the like.

Figure 7:
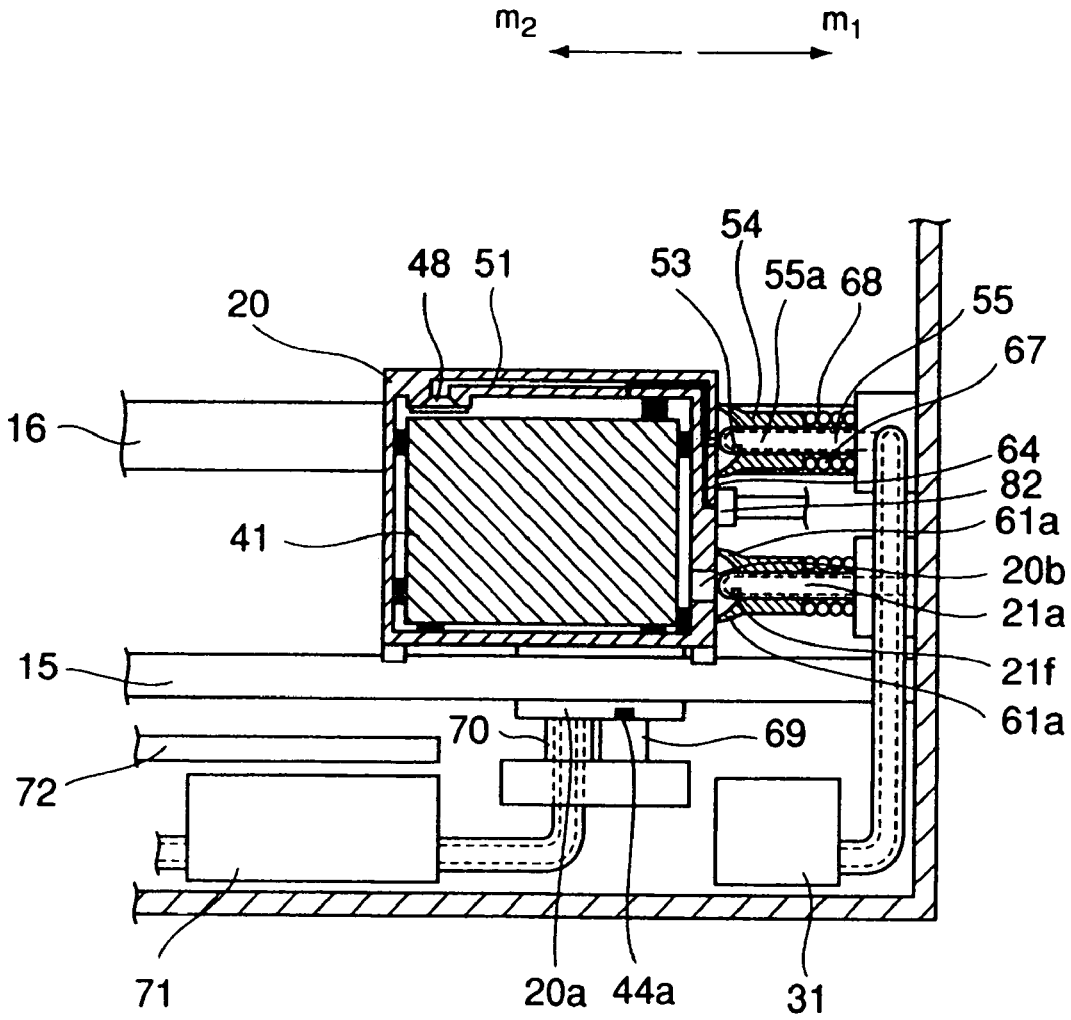
FIG. 7 is a longitudinal sectional view showing a state of ink replenishment of the inkjet printer.

FIG. 7 shows a state wherein the ink is to be supplied to the reservoir ink tank 20. When replenishing the ink, the printhead 20*a* is further moved in the direction of an arrow $m_1$ from the home position shown in FIG. 6, and is positioned at the ink replenish position. In this manner, when the printhead 20*a* moves to the ink replenish position, the cap members 69 and 70 move upward, and the replenishing cap member 69 closes the orifice surface 44*a* of the printhead 20*a*. The replenishing cap member 69 seals the orifice 44 of the printhead 20*a*. The supply cap member 61 moves relative to the pipe 21*a* to open the communication hole 21*f* while it closes the ink intake port 20*b*. The communication hole 21*f* opens to the reservoir ink tank 20 to form an ink supply channel between the reservoir ink tank 20 and a replenish ink tank 22. As the cap member 61 closes the vent hole 64, the ink will not flow from the reservoir ink tank 20 into the vent hole 64.

The cap member 54 moves relative to the conduit 55 to open the communication hole 55*a*. The communication hole 55*a* forms a suction channel between the common suction port 53 and a replenishing suction pump 31. A porous member 48 is incorporated in the suction channel.

To replenish the ink, air in the reservoir ink tank 20 is drawn by suction with the replenishing suction pump 31 through the porous member 48, and is discharged into the waste liquid container (not shown). Thus, the interior of the reservoir ink tank 20 is set at a negative pressure, and the negative pressure draws the ink in the replenish ink tank 22 into the reservoir ink tank 20. The ink flowing into the reservoir ink tank 20 soaks into an ink reservoir 41. As the ink soaks, the liquid level of the ink rises.

The rising speed of the liquid level of the ink depends on the suction force of the replenishing suction pump 31, and is accordingly set at an appropriate speed in accordance with the actuated amount of the replenishing suction pump 31. When the liquid level of the ink reaches the porous member 48, as the porous member 48 does not transmit the ink, i.e., liquid molecules, through it, ink replenishment stops automatically.

Figure 5:
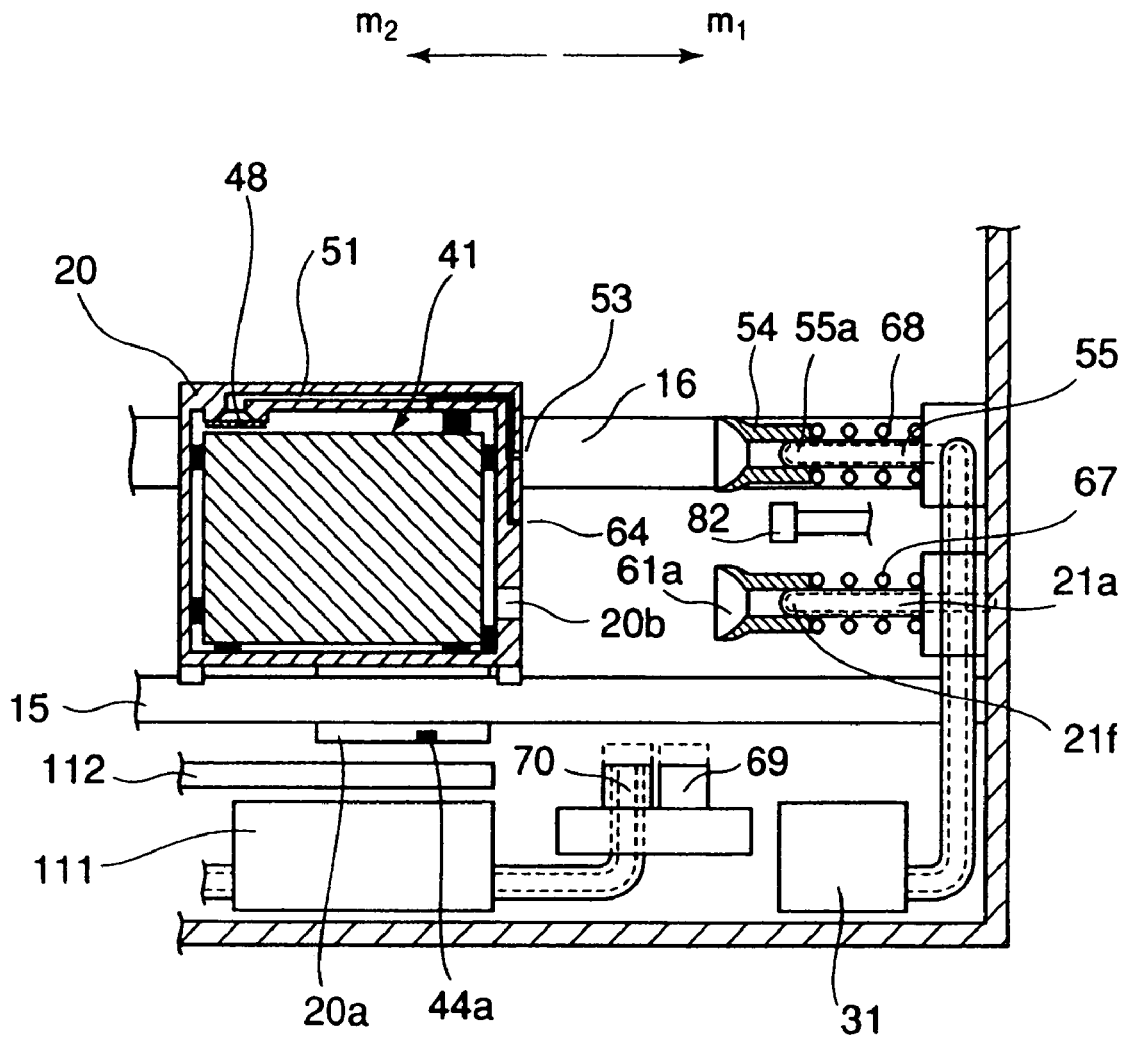
FIG. 5 is a longitudinal sectional view showing a state of printing of the inkjet printer.

When the ink suction operation is ended, the printhead 20*a* is moved to the home position or print operation position, so that the printer is restored to the state shown in FIG. 6 or 5.

Figure 3:
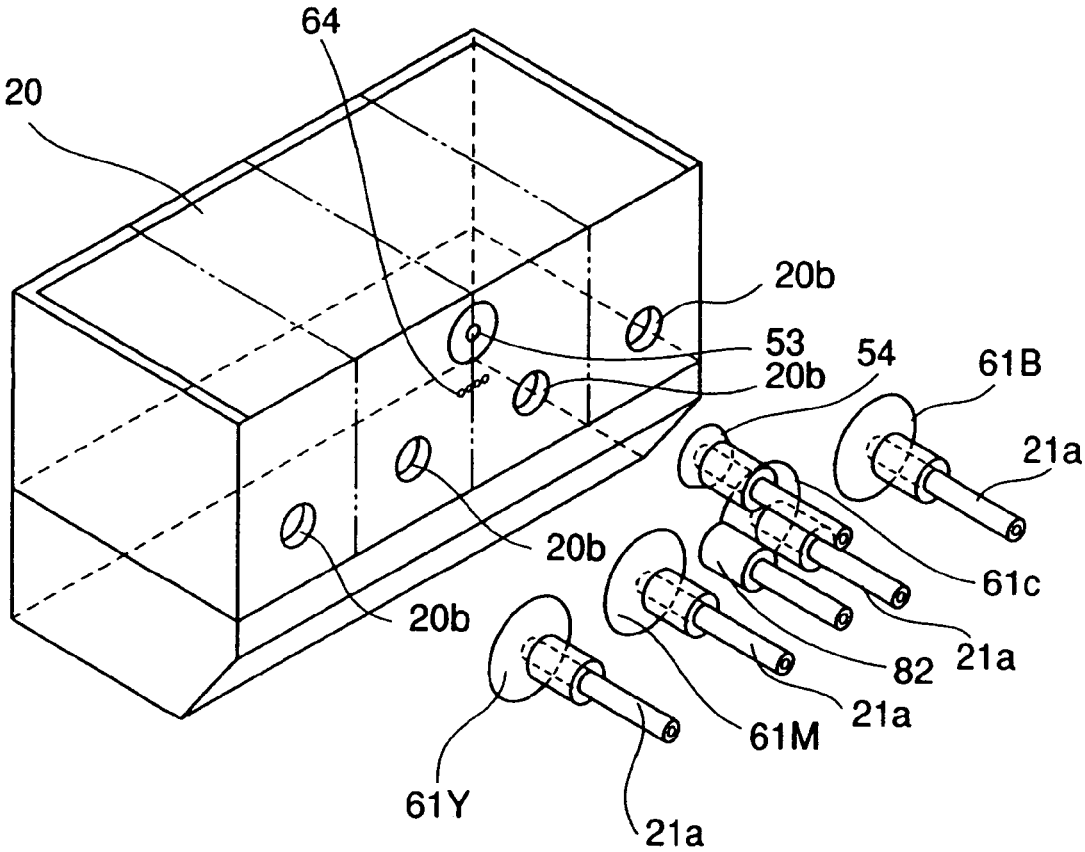
FIG. 3 is a perspective view showing a head cartridge provided to the inkjet printer.
Figure 4:
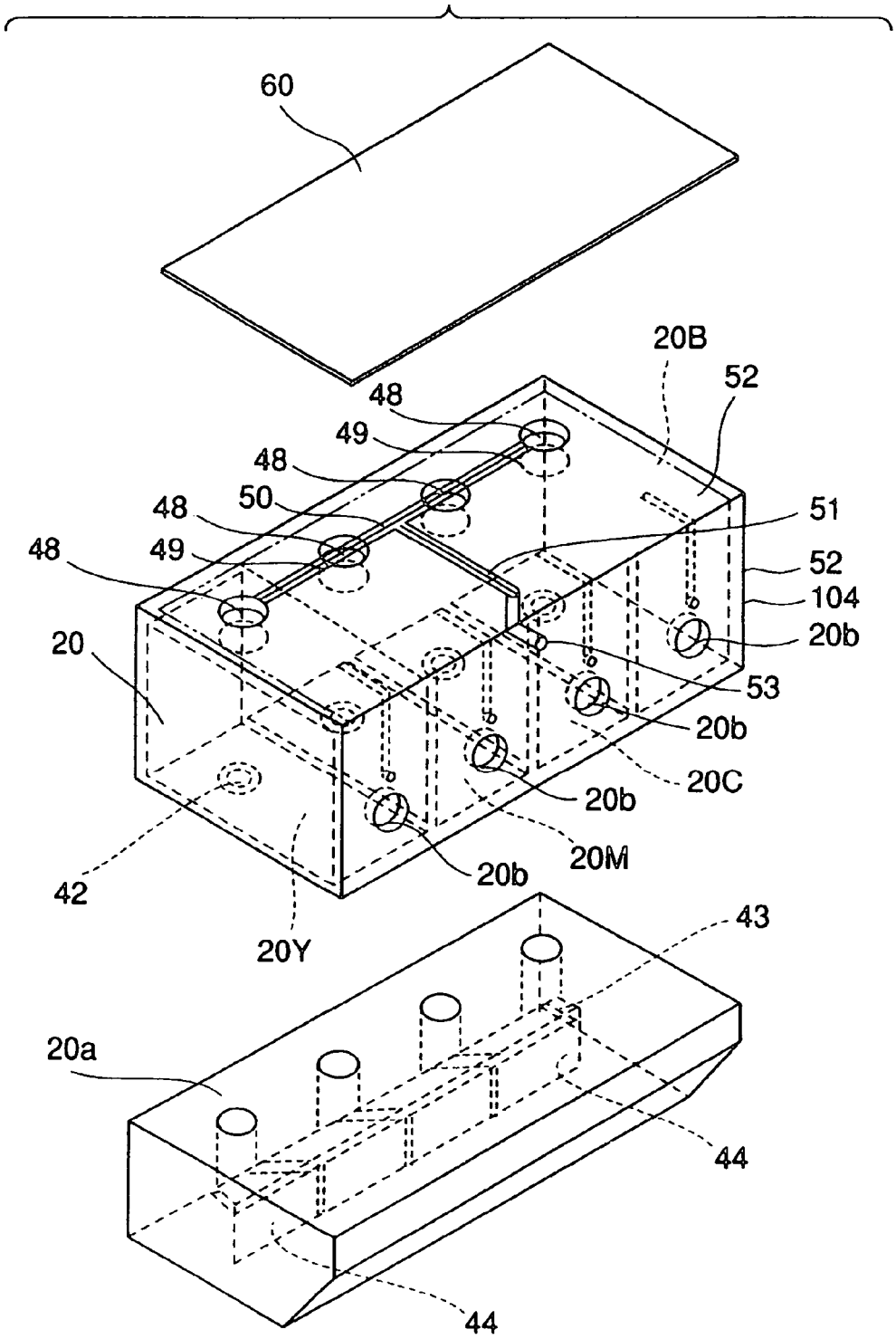
FIG. 4 is an exploded perspective view showing the head cartridge.

FIG. 3 is a perspective view of the head cartridge, and FIG. 4 is an exploded perspective view of the head cartridge.

More specifically, the printhead 20*a* is constituted by a plurality of head portions independent of each other for the respective ink colors. Each head portion has a common ink chamber 43 communicating with a corresponding ink supply port 42 of the reservoir ink tank 20, and a plurality of orifices 44 for discharging ink droplets. A discharge energy generator (not shown) for generating an energy necessary for discharging the ink from the orifices 44 is formed at an ink channel through which the common ink chamber 43 and orifices 44 communicate with each other.

According to this embodiment, the grooves in the upper surfaces of the reservoir ink tanks 20 and a top plate 60 connected to the upper surfaces form vent channels 49 to 51 and 52 between the reservoir ink tanks 20 and the common suction port 53, and between the reservoir ink tanks 20 and the vent hole 64. The vent hole 64 of this embodiment has a comparatively small diameter. To prevent the vent hole 64 from being closed with the ink attaching to the ink intake ports 20*b* and their vicinities, the sectional areas of the vent channels 52 themselves may not be changed, but only the open end of the vent hole 64 may be formed large. Each reservoir ink tank 20 has a porous member 48.

The porous member 48 provided in each reservoir ink tank 20 serves as a gas/liquid separating member which does not transmit the ink through it but transmits only a gas such as air or water vapor. The porous member 48 forms a thin film made of, e.g., PTFE (tetrafluoroethylene resin) or a similar resin porous material. As shown in FIG. 4, the discharge channel of the air in each reservoir ink tank 20 communicates from the corresponding porous member 48 and vent channel 49 to the common suction port 53 through the common vent channels 50 and 51. Air in the reservoir ink tank 20 is drawn by suction with the replenishing suction pump 31 from the cap member 54, which is in tight contact with the open surface of the common suction port 53, through the conduit 55, as will be described later. In other words, the vent channels 49 to 51, the common suction port 53, and the like correspond to the negative pressure introducing portion of the present invention.

The porous member 48 suffices as far as it has a gas/liquid separating function. Various types of materials can be used as the porous member 48 in accordance with the ink type and the application purposes of the porous member 48. For example, other than a gas permeable film made of tetrafluoroethylene resin or a similar porous resin material, porcelain, unglazed earthenware, a ceramic material, or a similar porous material may be used. Alternatively, a mechanical valve that opens when gas is to pass through and closes when the liquid is to pass through may be used as a gas permeable member.

As the material of the porous member 48, for example, a fluoroplastic such as PTFE (polytetrafluoroethylene), polychlorotrifluoroethylene, a tetrafluoroethylene-hexafluoropropylene copolymer, a tetrafluoroethylene-perfluoroalkylvinylether copolymer, tetrafluoroethylene-ethylene copolymer, or the like is particularly excellent because it has excellent gas permeability and chemical resistance. For example, a film obtained by making porous a PTFE sheet by monoaxial or biaxial orientation is particularly suitable. When a PTFE porous film is used as the porous member 48, it may be laid on a gas permeable support member so that mechanical strength is ensured. As the support member, an unwoven fabric, a woven fabric, a net, or the like can be used.

The porous member 48 may undergo a liquid repellent treatment in accordance with the nature of the ink. As the liquid repellent treatment agent, various types of fluorine-containing polymer having a perfluoroalkyl group can be used. A polymer having a fluorine-containing chain forms a low-surface-free-energy film on the surface of the fiber to exhibit a liquid repellent effect. The liquid repellent treatment can be performed by impregnating or coating by spraying the porous member 48 with the liquid repellent treatment agent. The coating amount of the liquid repellent treatment agent is preferably adjusted such that sufficient liquid repellency is obtained and gas permeability of the porous member 48 is not interfered with.

As shown in FIGS. 3 and 4, the common suction port 53 and ink intake ports 20*b* are formed in the side surfaces of the reservoir ink tanks 20. The grooves formed on the upper surfaces of the reservoir ink tanks 20 and the top plate 60 connected to the grooves of the upper surfaces form an air discharge channel between respective reservoir ink tanks 20Y, 20M, 20C, and 20Bk and the common suction port 53, and between the respective reservoir ink tanks 20Y, 20M, 20C, and 20Bk and the vent hole 64. The vent hole 64 is sealed by a seal member 82 when the ink is to be supplied. Four vent holes 64 for the four different colors are arranged at one location, so that one seal member 82 can seal them at once. These vent holes 64 are independent of each other at four positions so that when the pressures in the reservoir ink tanks 20 fluctuate and the inks flow out, the inks are prevented from being mixed with each other in the ink channel.

In the embodiment described above, the porous member 48 is attached to the reservoir ink tank 20. The present invention can also be applied to an arrangement in which a porous member is provided in a printer corresponding to a reservoir ink tank.

A printer and a reservoir ink tank according to another embodiment like this will be described with reference to the accompanying drawings. For the sake of descriptive convenience, the same members as those of the printer described above are denoted by the same reference numerals, and a description thereof will be omitted.

Figure 8:
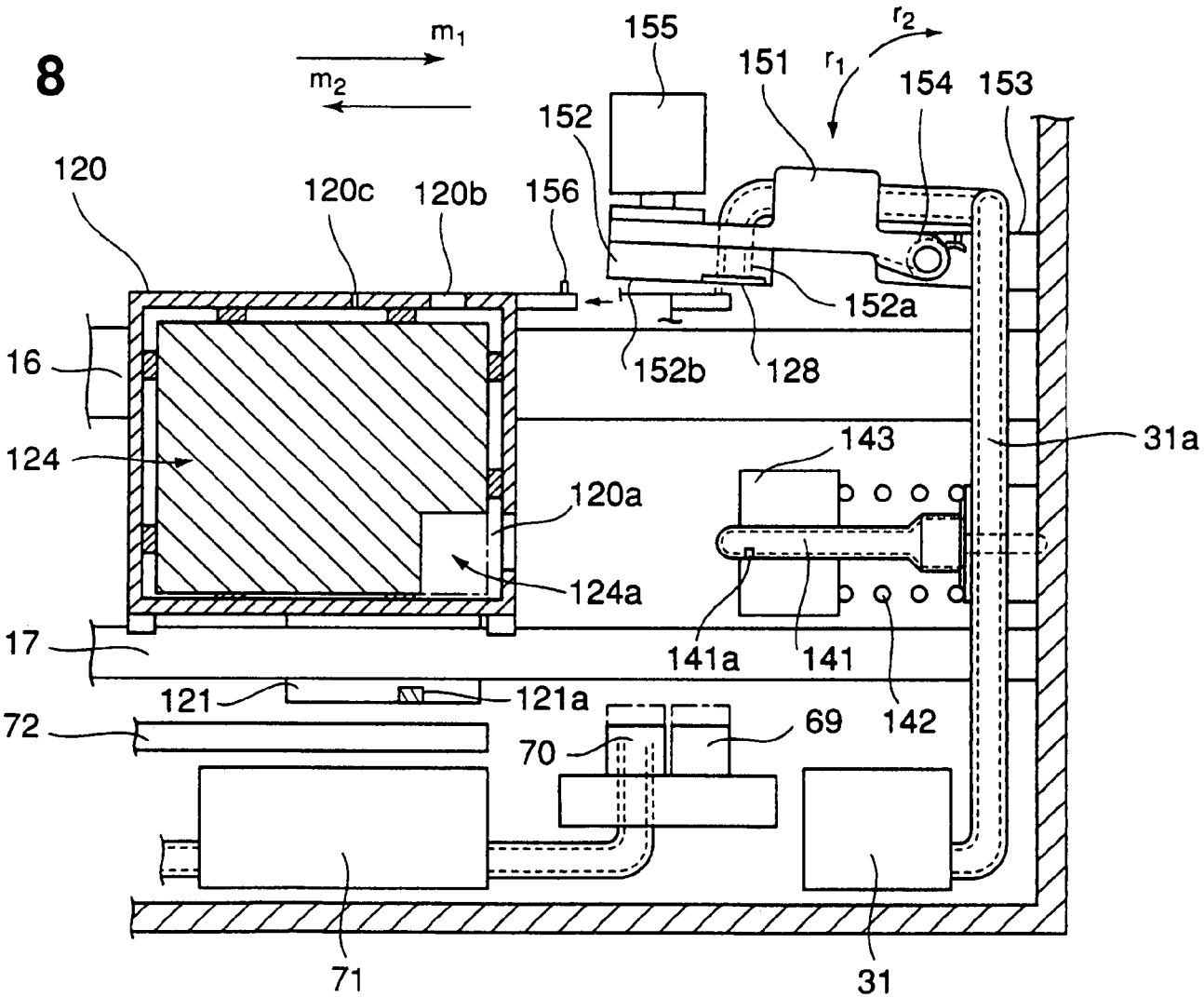
FIG. 8 is a cross-sectional view showing a state of printing of another inkjet printer.

As shown in FIG. 8, this printer has a porous member 128 at its position opposing a common suction port 53 of a reservoir ink tank 120 in an ink replenish state.

A printhead 121 which can discharge ink in the reservoir ink tank 120 through its nozzle portion 121*a* is provided to the reservoir ink tank 120, and is supported to be movable in the directions of arrows $m_1$ and $m_2$ as the main scanning direction along guide shafts 15 and 16. The reservoir ink tank 120 and printhead 121 may be detachably mounted on a carriage guided by the guide shafts 15 and 16.

An ink reservoir 124 for holding the ink is provided in the reservoir ink tank 120. As shown in FIG. 8, the ink reservoir 124 has a notch 124*a* where the distal end of a projecting member 141 (to be described later) for supplying the ink is to be inserted. Except for the notch 124*a*, the ink reservoir 124 has an outer shape as indicated by an alternate long and two short dashed line in FIG. 8. The reservoir ink tank 120 has an ink intake port 120*a* for taking the ink into the ink reservoir 124, a suction port 120*b*, a vent hole 120*c*, and an ink supply port (not shown) communicating with the printhead 121.

Figure 9:
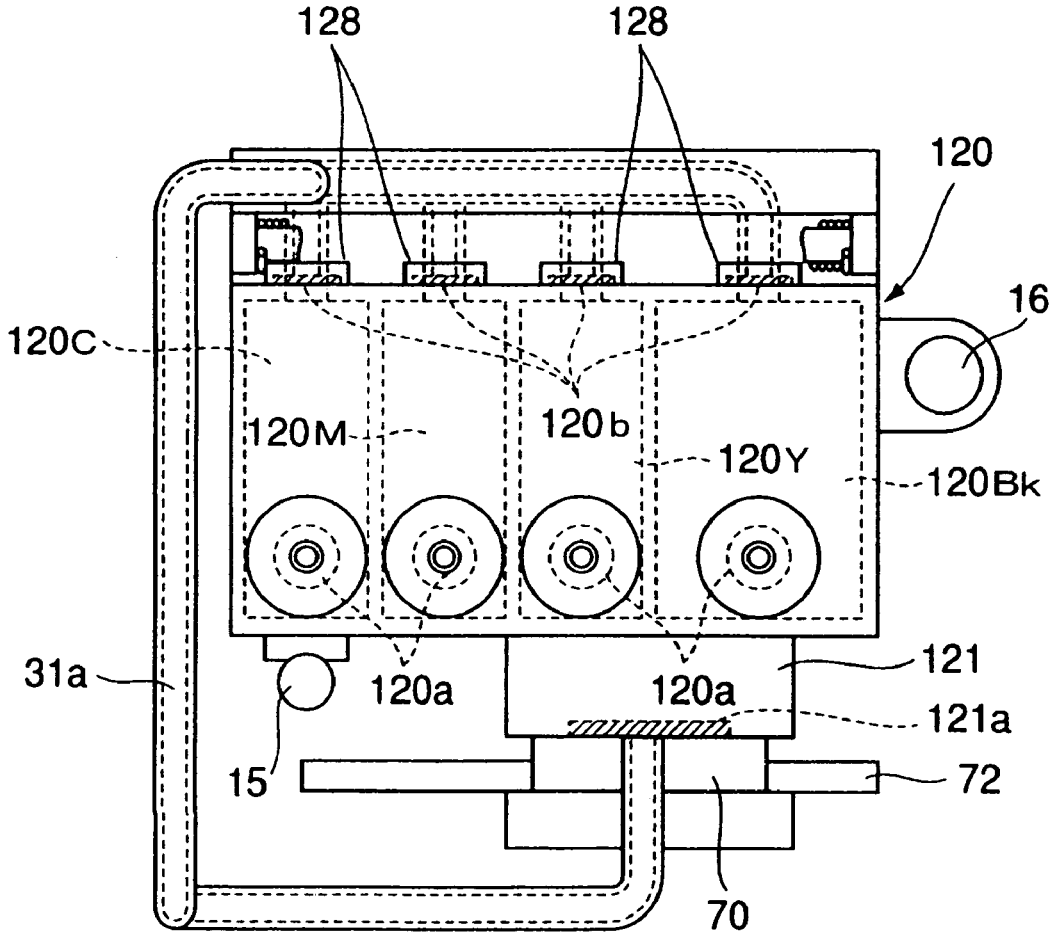
FIG. 9 is a side view showing a reservoir ink tank provided to the inkjet printer shown in FIG. 8.

In this embodiment, as shown in FIG. 9, the reservoir ink tank 120 has ink storages 120C, 120M, 120Y, and 120Bk which store inks of cyan, magenta, yellow, and black. Each of the ink storages 120C, 120M, 120Y, and 120Bk has an ink intake port 120*a*, suction port 120*b*, vent hole 120*c*, and ink supply port. Considering the fact that black ink is used often, the ink storage 120Bk for the black ink is formed larger than any other ink storages 120C, 120M, and 120Y. The nozzle portion 121*a* of the printhead 121 is provided for each ink color. Note that the reservoir ink tank 120 and printhead 121 may be connected to each other to form an inkjet cartridge, or may be divisionally provided for each ink color.

The hollow projecting member 141 is provided in the printer. A seal member 143 which is biased to the left by a coil spring 142 is slidably fitted on the outer surface of the projecting member 141. The projecting member 141 has a through hole 141*a* which is opened/closed by the seal member 143. The projecting member 141 has a closed distal end, and its proximal end is connected to a replenish ink tank 22.

An arm member 151 is axially supported by a support member 153 in the printer to be pivotal in the directions of arrows $r_1$ and $r_2$ in FIG. 8, and is biased by the elastic force of a torsion coil spring 154 in the direction of the arrow $r_1$. A seal member 152 for covering the suction ports 120*b* and vent holes 120*c* of the reservoir ink tank 120 is attached to the distal end of the arm member 151.

The seal member 152 has an opening 152*a* which communicates with the suction port 120*b*, and a seal surface 152*b* which can close the suction port 120*b* and vent hole 120*c*. The opening 152*a* is connected to a replenishing suction pump 31 through a suction pipe 31*a*. In the case of this embodiment, the openings 152*a* of the ink storages 120C, 120M, 120Y, and 120Bk are put together through the suction pipe 31*a*, as shown in FIG. 9, to communicate with the common replenishing suction pump 31.

The porous member 128 which does not transmit ink but transmits only gas through it is attached to each opening 152*a*. The porous member 128 is made of the same material as that of the porous member 48 described above, and its surface has undergone the same liquid repellent treatment as that for the porous member 48. A blade 156 which scrapes, by wiping, the lower surface of the seal member 152, including the porous member 128, is provided to the reservoir ink tank 120. A stopper member 155 which regulates the upper position of the arm member 151 is provided at a position opposing the distal end of the arm member 151.

A printing medium S is conveyed by a convey mechanism (not shown) in the subscanning direction perpendicular to the directions of the arrows $m_1$ and $m_2$ as the main scanning direction. When main scanning of the printhead 121 while discharging the ink and the convey operation of the printing medium S in the subscanning direction are repeated, an image or the like is sequentially formed on the printing medium S.

Figure 10:
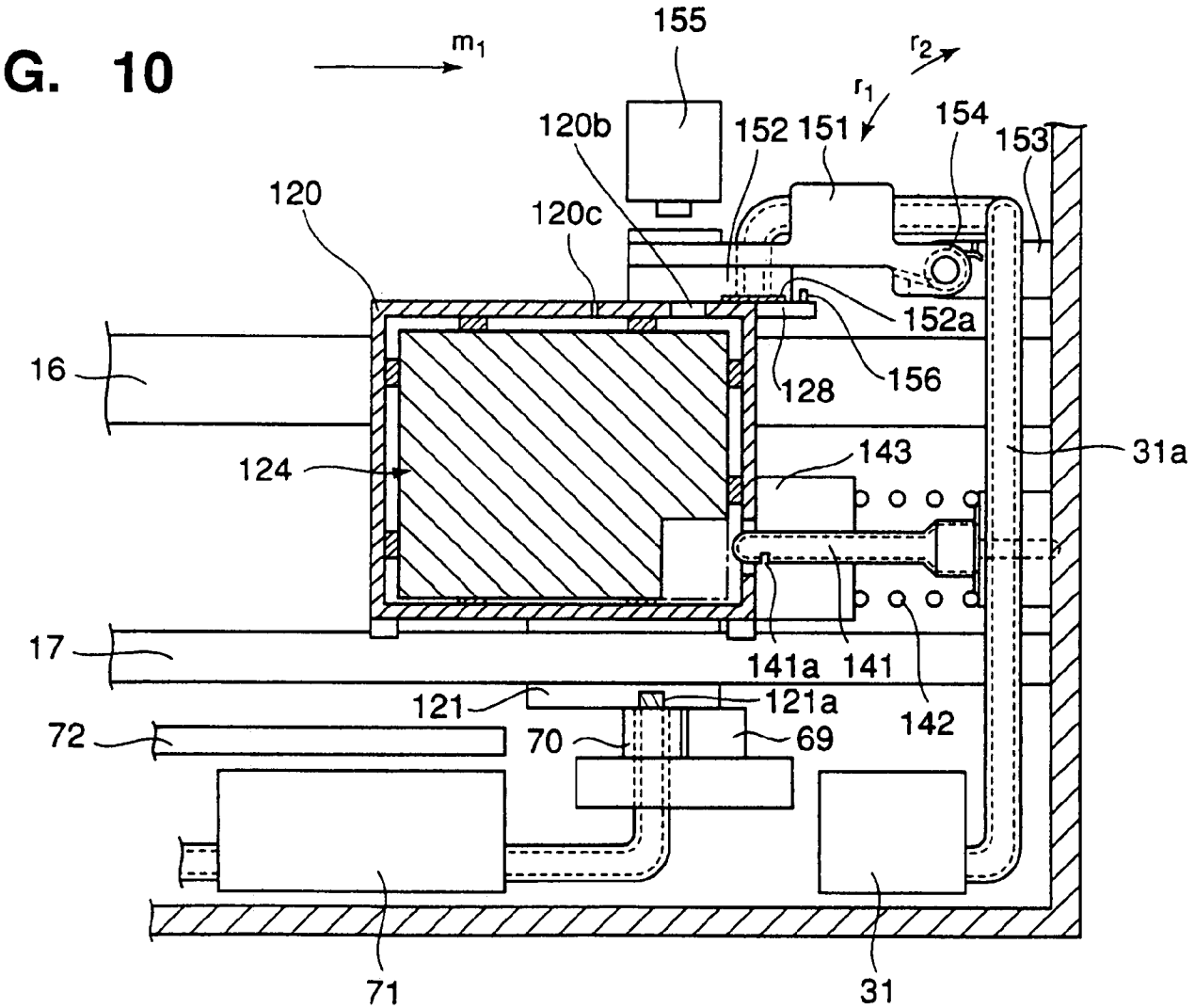
FIG. 10 is a cross-sectional view showing a state of power OFF or waiting of the inkjet printer shown in FIG. 8.

In the print operation, the printhead 121 discharges the ink to print a character or image while moving at a position on the left of the home position shown in FIG. 10 in the directions of the arrows $m_1$ and $m_2$.

As shown in FIG. 10, when the printhead 121 moves to the home position, cap members 69 and 70 move upward. The recovery processing cap member 70 caps the nozzle portion 121*a* of the printhead 121. At this time, the seal member 143 closes the ink intake port 120*a* while closing the through hole 141*a* of the projecting member 141, and the seal member 152 closes the suction port 120*b*. When the ink intake port 120*a* and suction port 120*b* are closed in this manner, an increase in viscosity of the ink in the reservoir ink tank 120 is prevented.

The porous member 128 is positioned separate from the suction port 120*b* in the direction of the arrow $m_1$, so it will not come into contact with the ink in the reservoir ink tank 120. As a result, contact of the porous member 128 and the ink with each other for a long period of time is avoided, so that degradation in performance of the porous member 128 is prevented. The ink discharge state of the printhead 121 at the home position can be maintained well by the recovery process of discharging ink not contributing to printing images or the like. The recovery process includes a process of introducing the negative pressure generated by a recovery processing suction pump 71 into the recovery processing cap member 70 to forcibly draw by suction and discharge the ink from the orifice of the nozzle portion 121*a*, and a process of discharging the ink from the orifice of the nozzle portion 121*a* into the recovery process cap member 70.

Figure 11:
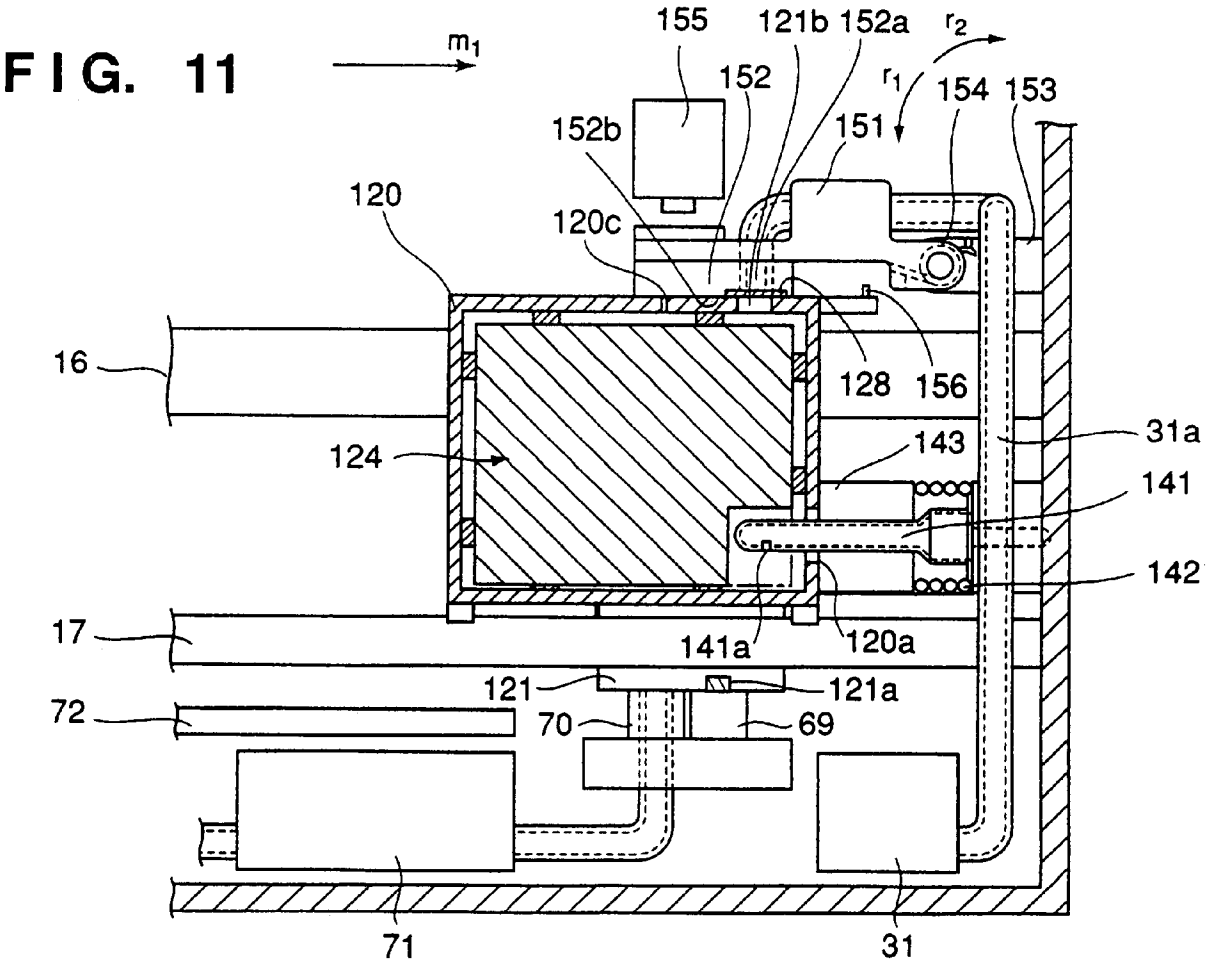
FIG. 11 is a cross-sectional view showing a state of ink replenishment of the inkjet printer shown in FIG. 8.

When replenishing the ink, as shown in FIG. 11, the printhead 121 further moves from the home position to the ink replenish position in the direction of the arrow $m_1$. When the printhead 121 moves to the ink replenish position, the cap members 69 and 70 move upward, and the replenishing cap member 69 caps the nozzle portion 121*a* of the printhead 121. The replenishing cap member 69 seals the orifice of the nozzle portion 121*a*. At this time, the seal member 152 moves relative to the projecting member 141 to open the through hole 141*a*, while it closes the ink intake port 120*a*. The through hole 141*a* opens to the reservoir ink tank 120 to form an ink supply system between the reservoir ink tank 120 and replenish ink tank 22. The seal member 152 closes the vent hole 120*c*, and connects the opening 152*a* to the suction port 120*b* to form an air suction system between the suction port 120*b* and a replenishing suction pump 31. The porous member 128 is interposed in the suction system.

To replenish the reservoir ink tank 120 with ink, air in the reservoir ink tank 120 is drawn by suction with the replenishing suction pump 31 through the porous member 128, and is discharged into a waste liquid container (not shown). Thus, the interior of the reservoir ink tank 120 is set at a negative pressure, and the negative pressure draws the ink in the replenish ink tank 22 into the reservoir ink tank 120 by suction. The ink flowing into the reservoir ink tank 120 soaks into the ink reservoir 124. As the ink soaks, the liquid level of the ink rises. The rising speed of the liquid level of the ink depends on the suction force of the replenishing suction pump 31, and is accordingly set at an appropriate speed in accordance with the actuated amount of the replenishing suction pump 31. When the liquid level of the ink reaches the porous member 128, as the porous member 128 does not transmit a liquid such as ink through it, ink replenishment stops automatically. Ink replenishment is started for the ink storages 120C, 120M, 120Y, and 120Bk simultaneously, and is automatically stopped sequentially by the porous member 128 starting with an ink storage that has been filled with the ink first.

When the ink replenish operation is ended, the printhead 121 is moved to the home position or print operation position, so that the printer is restored to the state shown in FIG. 10 or 8.

As the reservoir ink tank 120 moves, the blade 156 abuts against the lower surface of the seal member 152, to wipe the lower surface of the seal member 152, including the porous member 128, while pivoting the arm member 151 in the directions of the arrows $r_1$ and $r_2$, as indicated by an alternate long and two short dashed line in FIG. 8. With this wiping operation, foreign substances such as viscous ink attaching to the porous member 128, opening 152*a*, and seal surface 152*b* are removed, so that the porous member 128, opening 152*a*, and seal surface 152*b* are kept in a good state.

Figure 12B:
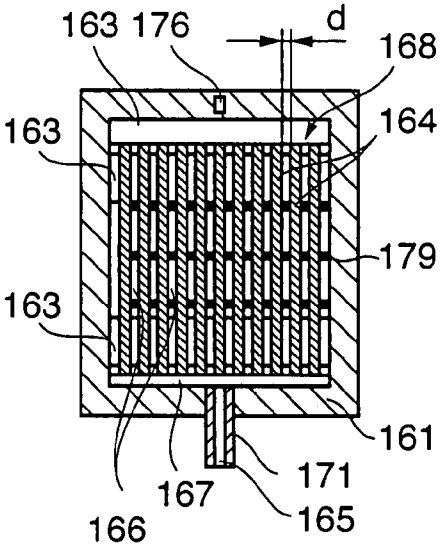
Figure 12C:
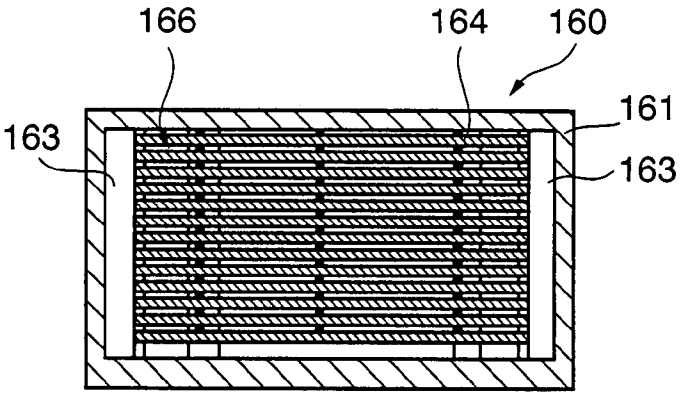
Figure 12A:
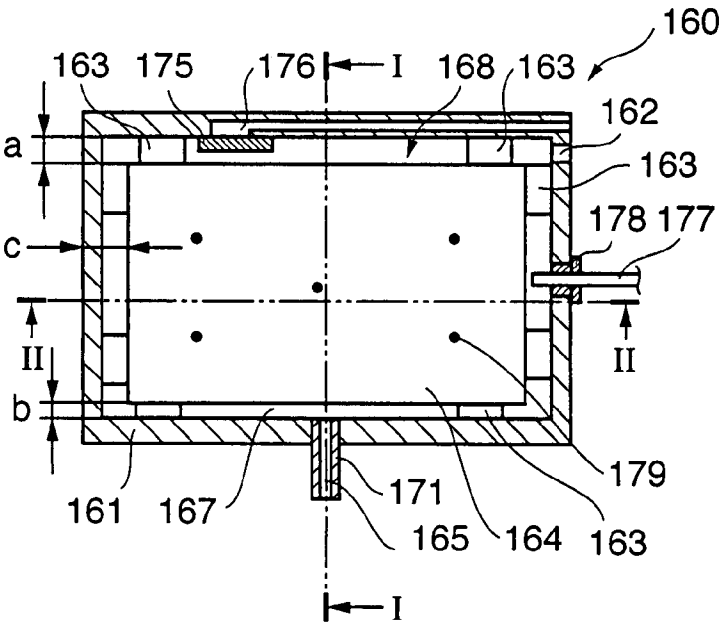

Of the printer with the above arrangement, a reservoir ink tank according to the first example which applies the structure of the ink reservoir according to the present invention will be described with reference to FIGS. 12A, 12B, and 12C. To facilitate understanding of the arrangement, FIGS. 12A, 12B, and 12C shows only an ink reservoir for one ink color. In the case of a multicolor printer, a plurality of ink reservoirs having almost the same structures are arranged side by side, as shown in FIG. 4.

As shown in FIGS. 12A, 12B, and 12C, a housing 161 of a reservoir ink tank 160 has, in its one side surface, an air intake port 162 communicating with the interior of the housing 161. An ink supply pipe 171 having an ink supply port 165 is arranged at the center of the bottom surface of the housing 161. Ink is supplied from the ink supply port 165 to the printhead, and air is externally taken in through the air intake port 162.

The housing 161 of the reservoir ink tank 160 has, in its one side surface, an ink intake port 170 for taking the ink into the housing 161. The ink intake port 170 is hermetically sealed with a seal member 178.

The housing 161 of the reservoir ink tank 160 has a vent channel 176 in its upper surface. The vent channel 176 serves to introduce the negative pressure into an ink reservoir 166 (to be described later) when supplying the ink. When the ink is supplied to the ink reservoir 166 through an ink supply pipe 177 and its liquid level reaches a porous member 175, ink supply stops automatically. The seal member 178 ensures hermeticity in the housing 161 when the ink supply pipe 177 is connected to it.

As shown in FIG. 12A, a plurality of thin bodies 164 are disposed parallel to each other at gaps from each other and in the housing 161, and their outer surfaces are supported and fixed by a plurality of support members 163. The support members 163 are arranged in the housing 161 at positions to oppose the corners of the plurality of thin bodies 164, and ensure a predetermined gap between the thin bodies 164 and the inner wall of the housing 161.

The plurality of thin bodies 164 each have a substantially square shape, and are made of a material having sufficient wettability with respect to the ink, or made of flat plates with treated surfaces. The gaps form the ink reservoir 166 among the plurality of thin bodies 164. When the ink reservoir 166 is filled with the ink, the reservoir ink tank 160 generates a capillary force. The ink is held by the capillary force.

The capillary force can be expressed by the following equation (1):

$$h=2T\cos\theta/\rho gr \quad (1)$$

where h [m] is the head, T [Nm] is the surface tension of the ink, θ is the contact angle of the ink with respect to the thin bodies, ρ [kg/m$^3$] is the ink density, g [m/s$^2$] is the gravitational acceleration, and r [m] is the radius of the capillary tube.

When the thin bodies are parallel plates with a gap size d and each having a length sufficiently larger than the gap size d, equation (1) can be approximated as:

$$h=4T\cos\theta/\rho gr \quad (2)$$

Therefore, for example, if t=0.03, cos θ=1, ρ=1063, and g=9.8, then h=115 [mm] for d=0.0001 [m] (=0.1 [mm]).

Similarly, calculation by employing the gap size d of the thin bodies as a parameter yields Table 1.

TABLE 1

| | Gap Size d [mm] of Thin Bodies | Head h [mm] |
|---|---|---|
| 1 | 0.5 | 23 |
| 2 | 0.3 | 38 |
| 3 | 0.2 | 58 |
| 4 | 0.1 | 115 |
| 5 | 0.05 | 230 |

The negative pressure to be applied to the printhead changes depending on the specifications of the printhead, but is usually about (−) 0 to (−) 200 [mm] head. Naturally, the negative pressure of the ink in the ink reservoir tank varies depending on the height difference between the printhead and the ink reservoir tank, and must accordingly be offset by this height difference.

Therefore, the negative pressure required of the ink to be supplied is desirably from minus several ten [mm] to minus 200 [mm] head. If the negative pressure is lower than the lower limit of this range, ink may leak from the orifice of the printhead. If the negative pressure is higher than the upper limit of this range, ink shortage may occur in ink supply, printing density may decrease due to insufficient ink supply, or the ink cannot be discharged. The gap size d of the ink reservoir 166 that satisfies this demand falls within the range of 0.05 [mm] (inclusive) to a little less than 0.5 [mm] (inclusive) from the result shown in Table 1.

A filling efficiency I [%] of the ink to the volume occupied by n thin bodies 164 is expressed by:

$$I=(n-1)\cdot d/\{nt+(n-1)\cdot d\} \quad (3)$$

in the form of the relationship with the gap size d of the ink reservoir 166 described above. To increase the ink filling efficiency, the thin body thickness t may be approximated to 0.

Regarding the material of the thin bodies 164, a material the decomposed material or additive of which will not elute in the ink, which does not react with the ink to produce a reaction product, or which will not entrap the ink to expand must be selected. As described above, considering the ink filling efficiency, the thin bodies are desirably made as thin as possible. Even if the thin bodies are made thin, they should preferably maintain a sufficiently large mechanical strength.

For example, during ink use, if ink exists between some thin bodies but does not between some thin bodies because of the nonuniform decrease of the ink, where the ink exists, the thin bodies are pulled inwardly by the negative pressure of the capillary force. When this force deforms the thin bodies to change the gap, the negative pressure also changes. The mechanical strength that does not cause this must be ensured.

Also, the mechanical strength must be ensured such that the thin bodies will not permanently deform to change their gaps upon mechanical vibration or impact.

To ensure the mechanical strength that maintains the constant gaps by using thinner bodies, it is effective to arrange, between the thin bodies, bosses having the same height as the gap size at several locations, as indicated by reference numeral 179 in FIGS. 12A to 12C.

As an inexpensive material that satisfies these demands, thin stainless steel bodies, or an olefin-based plastic such as polypropylene, polyethylene, or EVA (ethylene vinyl acetate resin), or a Teflon-based plastic such as PTFE (polytetrafluoroethylene), that can make a thin sheet easily is used. Alternatively, a polysulfone-based plastic or the like, which can be molded into thin bodies because of its good flowability, can be selected and employed considering the nature of the ink, assembling easiness, and the like.

Using an ink tank with the inner size of 10 mm×10 mm×31 mm and 0.1-mm thick stainless steel thin bodies, an ink tank with the structure of FIGS. 12A to 12C with a gap size of 0.1 mm among the thin bodies was fabricated on a trial basis. The ink filling efficiency was measured.

About 1.4 g of ink could be used, and a value close to the theoretical value of 1.55 g could be obtained.

With this ink tank size, the thickness of the stainless steel sheet employed posed no problem in strength. If the number and positions of the bosses are adjusted, it may be sufficiently possible to decrease the plate thickness to 0.05 mm or less.

The ink guide portion 167 is formed of the thin bodies 164 and the inner wall of the housing 161 where the ink supply port 165 is formed. The capillary force of the ink guide portion 167 is set to be larger than any capillary force generated by any portion formed in the ink reservoir apparatus to generate a capillary force. The support members 163 form a buffer 168, which does not generate a capillary force, around the thin bodies 164 to have a width a or c. When, e.g., ink containing a large amount of water freezes and expands in a low-temperature atmosphere in physical distribution or the like, the buffer 168 serves as a space which absorbs the expansion.

After the frozen ink melts, to let the ink in the buffer 168 return to the ink reservoir 166, the capillary force of the buffer 168 must be smaller than that of the ink reservoir 166.

Under these conditions, from the above expressions, the gap size d suffices as far as it satisfies $$b<d<(a \text{ or } c) \tag{4}$$

as far as the housing 161 and thin bodies 164 have the same wettability with respect to the ink.

FIGS. 13A, 13B, and 13C are views for explaining the flowing state of the ink in the ink reservoir 166. The ink in the ink reservoir 166 forms a meniscus 169 because it wets the thin bodies 164 and because of its surface tension, and generates a negative pressure in the ink. The ink is consumed as it is supplied from the ink supply port 165 to the printhead, and is consumed from the thin bodies 164 sequentially in order depending on the capillary force. The ink fills the ink guide portion 167 in the vicinity of the ink supply port 165 with higher priority, in order to generate a capillary force larger than that of the ink reservoir 166. For this reason, when the ink is supplied to the printer, it does not catch any air bubbles or the like but is stable.

The flow resistance of the ink is mostly the sheer stress of the ink against the thin bodies 164, and any other resistance component is hardly generated. Therefore, the reservoir ink tank according to this example is particularly suitable for an inkjet printer which consumes a large amount of ink within a short period of time and which has a comparatively high printing speed.

Second Embodiment

Figure 14B:
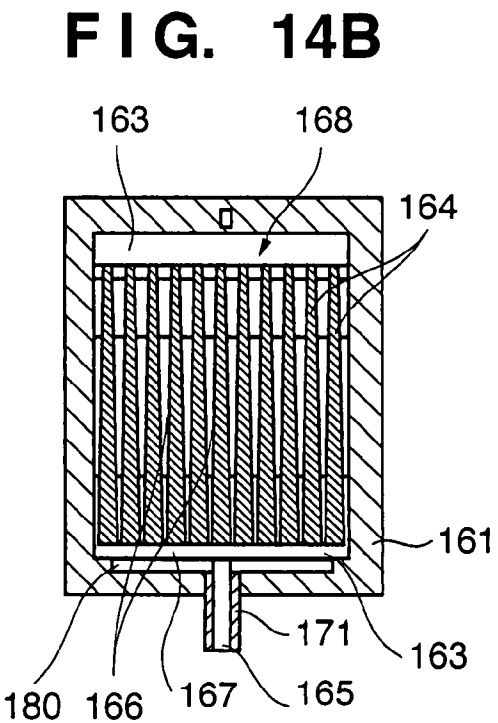
Figure 14C:
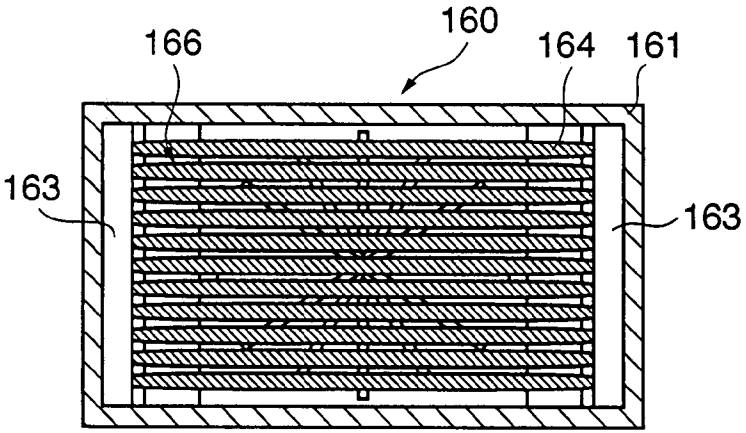
Figure 14A:
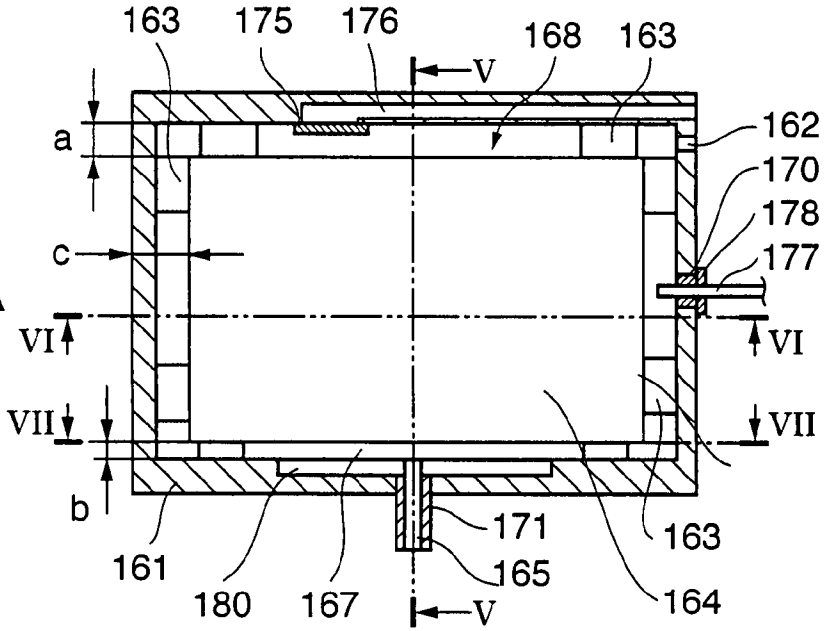

FIGS. 14A, 14B, and 14C show a reservoir ink tank according to the second embodiment which employs the structure of the present invention. In the reservoir ink tank of this embodiment, the arrangements and functions of the respective portions are the same as those of the reservoir ink tank of the first embodiment, but devices are added to this reservoir ink tank to further improve the reliability. In the reservoir ink tank of this embodiment, for the sake of descriptive convenience, the same members as those of the reservoir ink tank of the first embodiment described above are denoted by the same reference numerals, and a detailed description thereof will be omitted.

As shown in FIGS. 14A, 14B, and 14C, an ink reservoir 166 has a taper shape in which its gap size d gradually increases as the gap is more distant from the ink supply port 165.

Figure 15B:
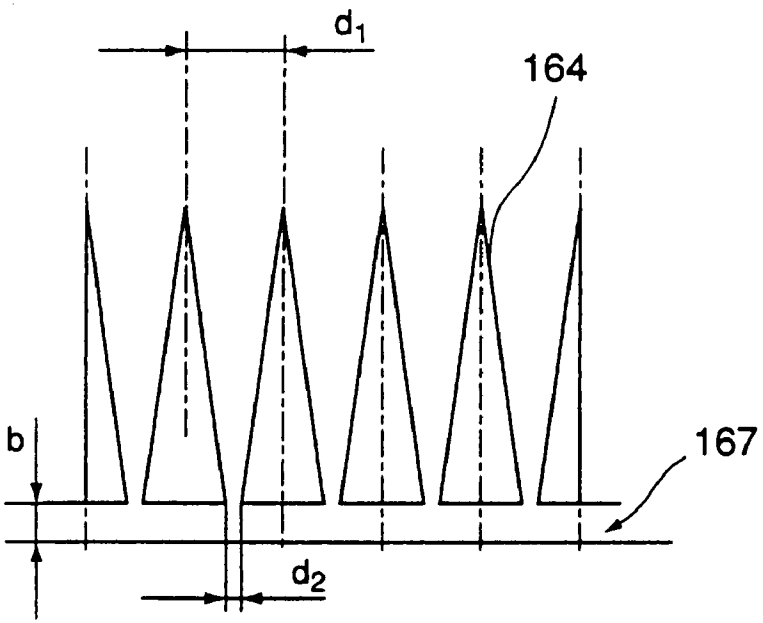
Figure 15C:
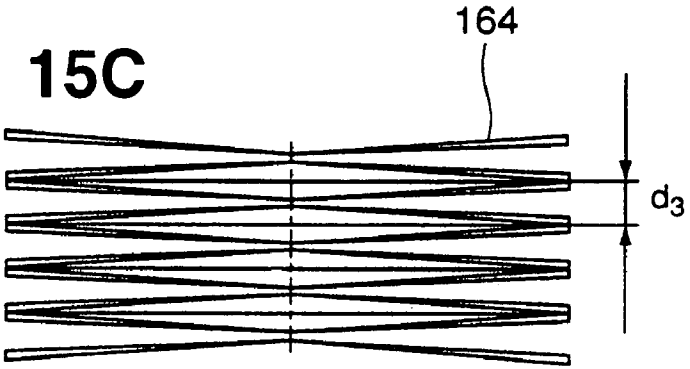
Figure 15A:
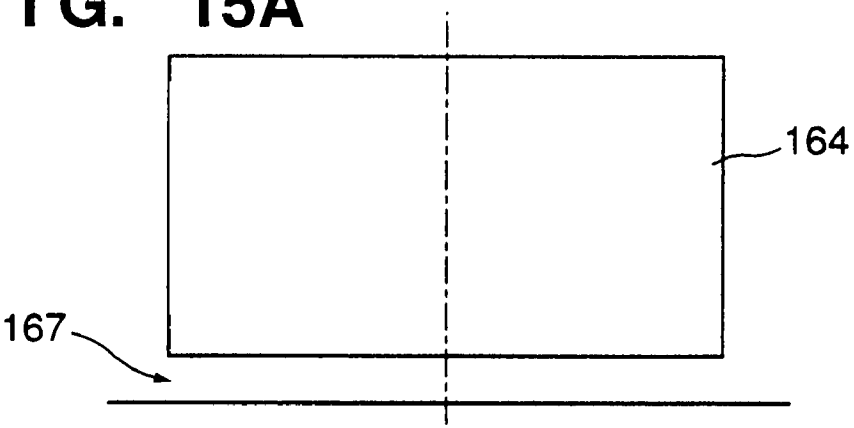

FIGS. 15A, 15B, and 15C are views for explaining the shapes of thin bodies 164 used for forming the ink reservoir 166 having the taper shape described above. As shown in FIGS. 15A, 15B, and 15C, the gap sizes d of the thin bodies 164 gradually increase toward the upper end, and gradually increase toward the side end which opposes the side surface of a housing 161.

As the ink reservoir 166 has the taper shape, the closer to the ink supply port 165, the larger the capillary force generated by the ink reservoir 166, so that the ink can be guided to the ink supply port 165 more reliably.

A plurality of grooves 180 are formed at a position adjacent to an ink guide portion 167. The grooves 180 are formed in the bottom surface in the housing 161. The capillary force of the grooves 180 is set to be equal to or more than that of the ink guide portion 167. When the capillary forces maintain this relationship, the ink can be guided to the ink supply port 165 reliably.

Figure 16:
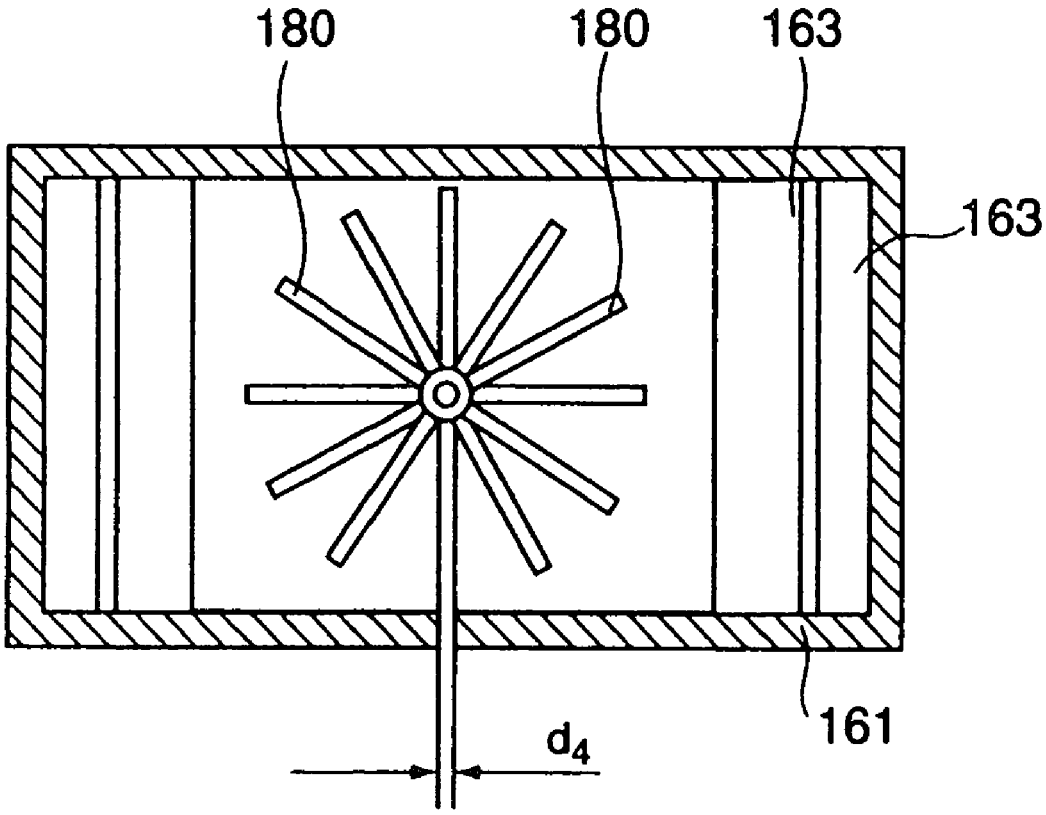
FIG. 16 is a sectional view taken along the line VII—VII of FIG. 14A to show grooves adjacent to an ink guide portion.

FIG. 16 is a plan view of an example of the grooves 180 formed adjacent to the ink guide portion 167. As shown in FIG. 16, the grooves 180 are formed radially about the ink supply port 165 as the center. The capillary force of the entire ink guide portion 167 is adjusted by a width $d_4$ of each groove 180. Therefore, as shown in FIGS. 15A, 15B, and 15C, this example is formed to satisfy $$(d_1, d_3)>d_2>b>d_4 \tag{5}$$

so that the capillary forces of the respective portions maintain an appropriate relationship.

Third Embodiment

Figure 17B:
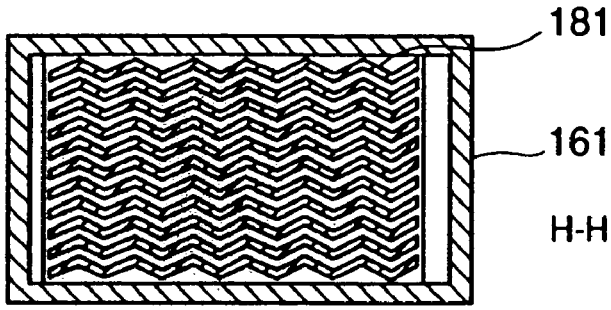
Figure 17A:
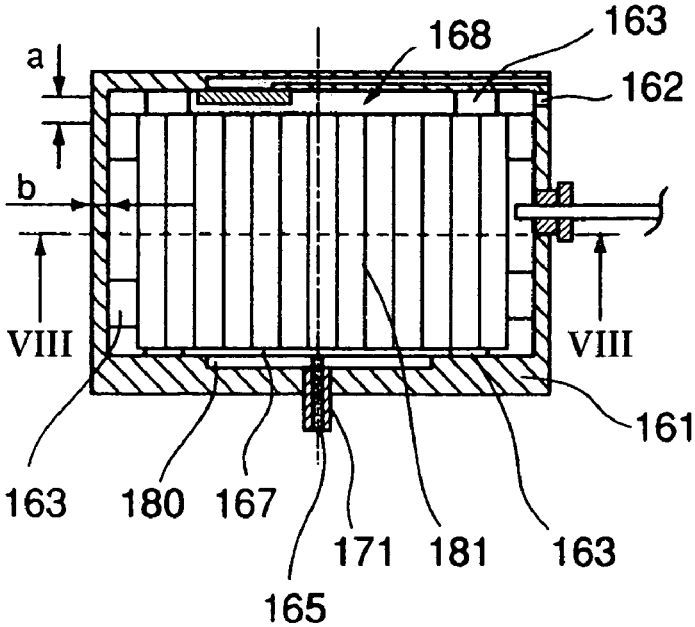

Finally, an ink reservoir tank according to the third embodiment will be described with reference to the accompanying drawings. FIGS. 17A and 17B show an ink reservoir tank according to the third embodiment. In the reservoir ink tank of this embodiment, for the sake of descriptive convenience, the same members as those of the reservoir ink tank of the first embodiment described above are denoted by the same reference numerals, and a description thereof will be omitted.

As shown in FIGS. 17A and 17B, according to this reservoir ink tank, thin bodies 181 each having a substantially wave shape are disposed in a housing.

Figure 18:
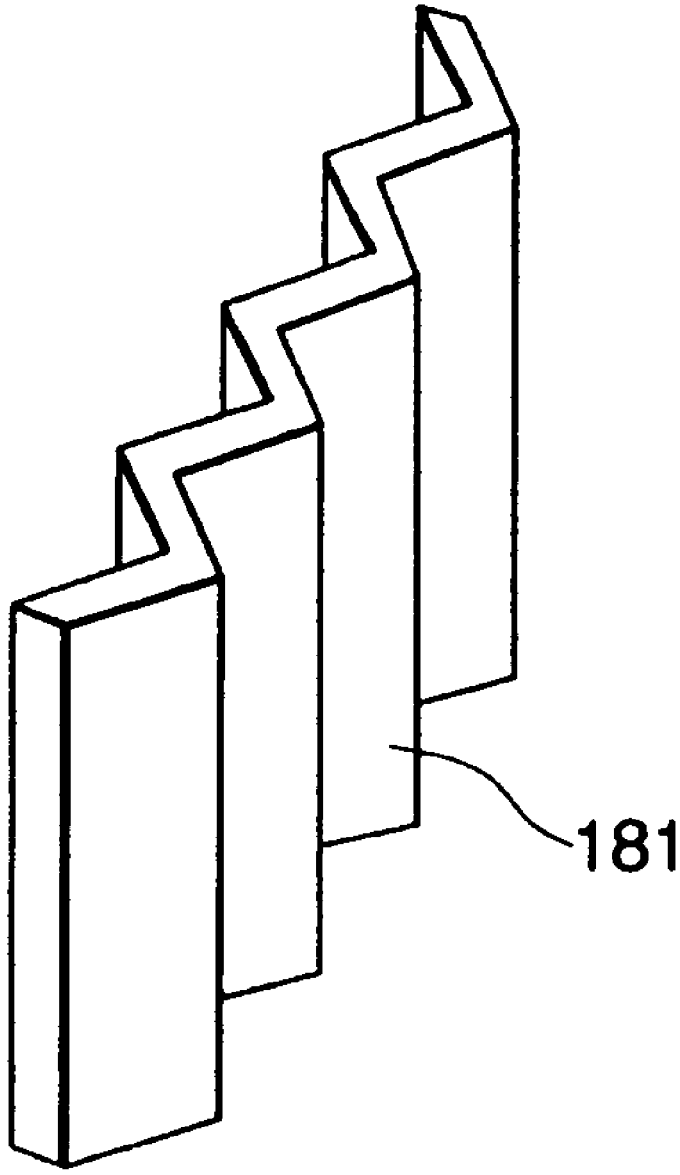
FIG. 18 is a perspective view showing a thin body constituting the ink reservoir.
Figure 19:
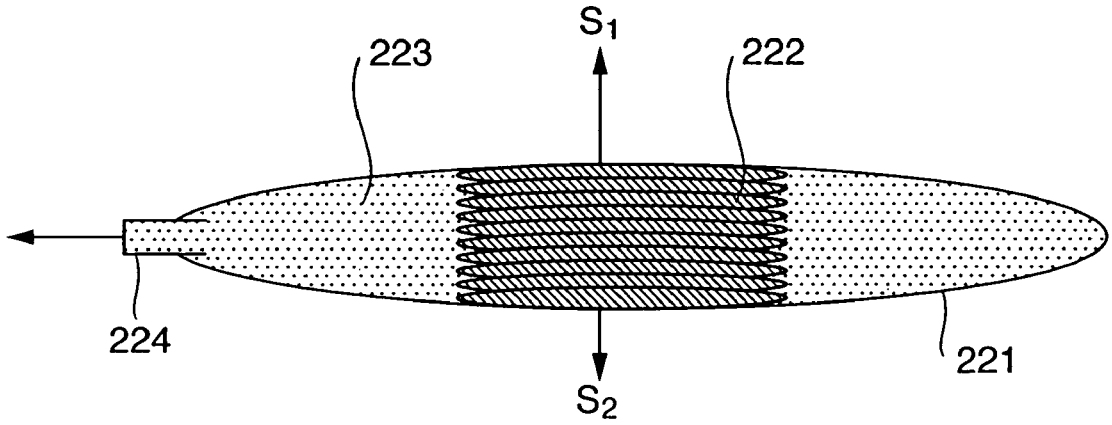
FIG. 19 is a schematic view for explaining the structure of a conventional spring-bag-scheme ink reservoir apparatus.
Figure 20:
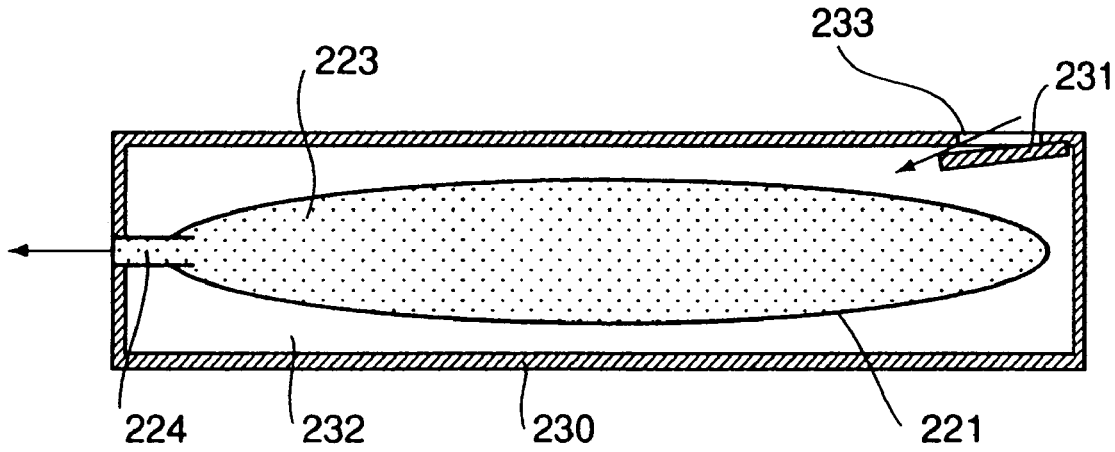
FIG. 20 is a schematic view for explaining the structure of a conventional pressure regulating-valve-added bag-scheme ink reservoir apparatus.
Figure 21:
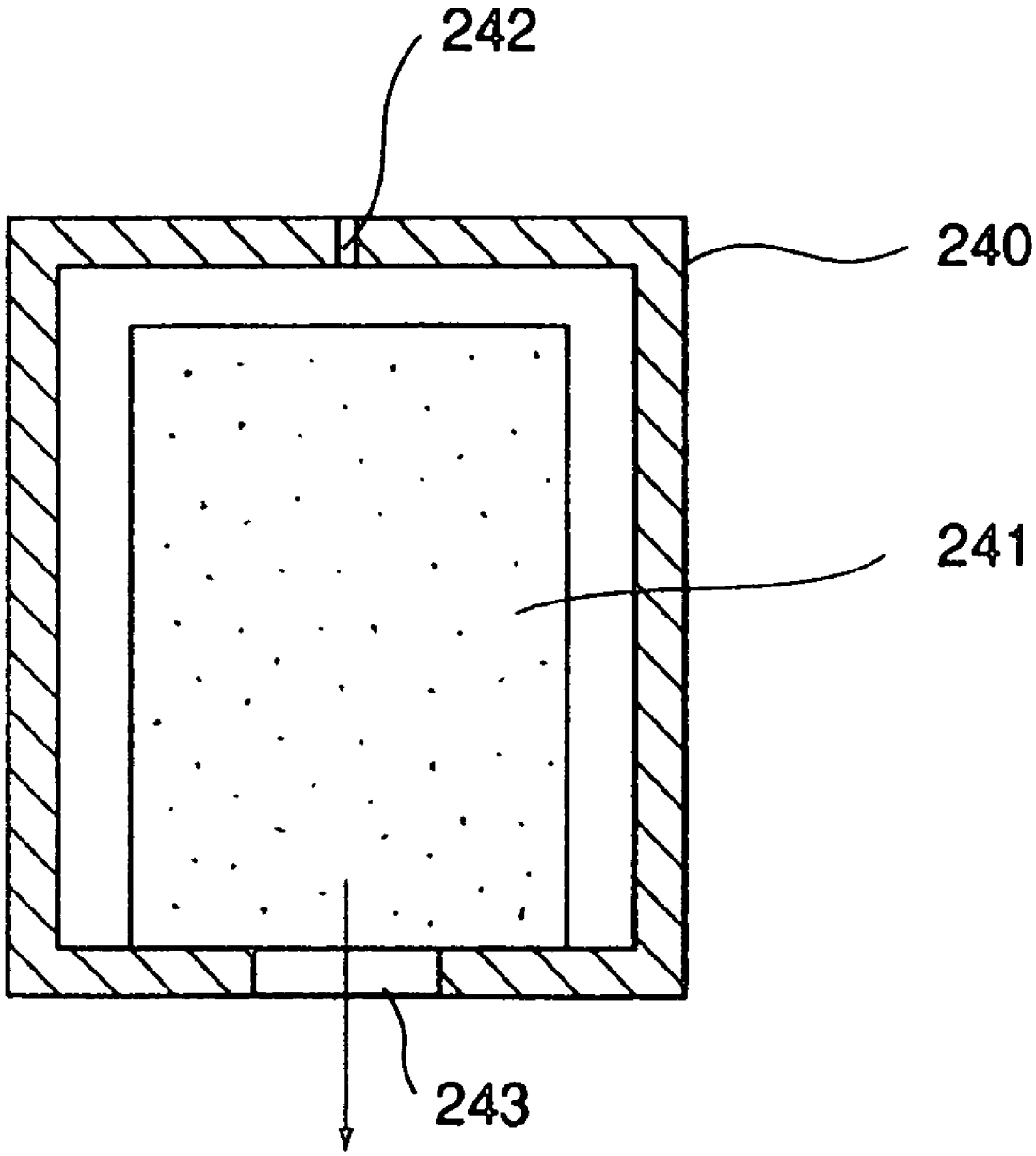
FIG. 21 is a schematic view for explaining the structure of a conventional sponge-scheme ink reservoir apparatus.
Figure 22:
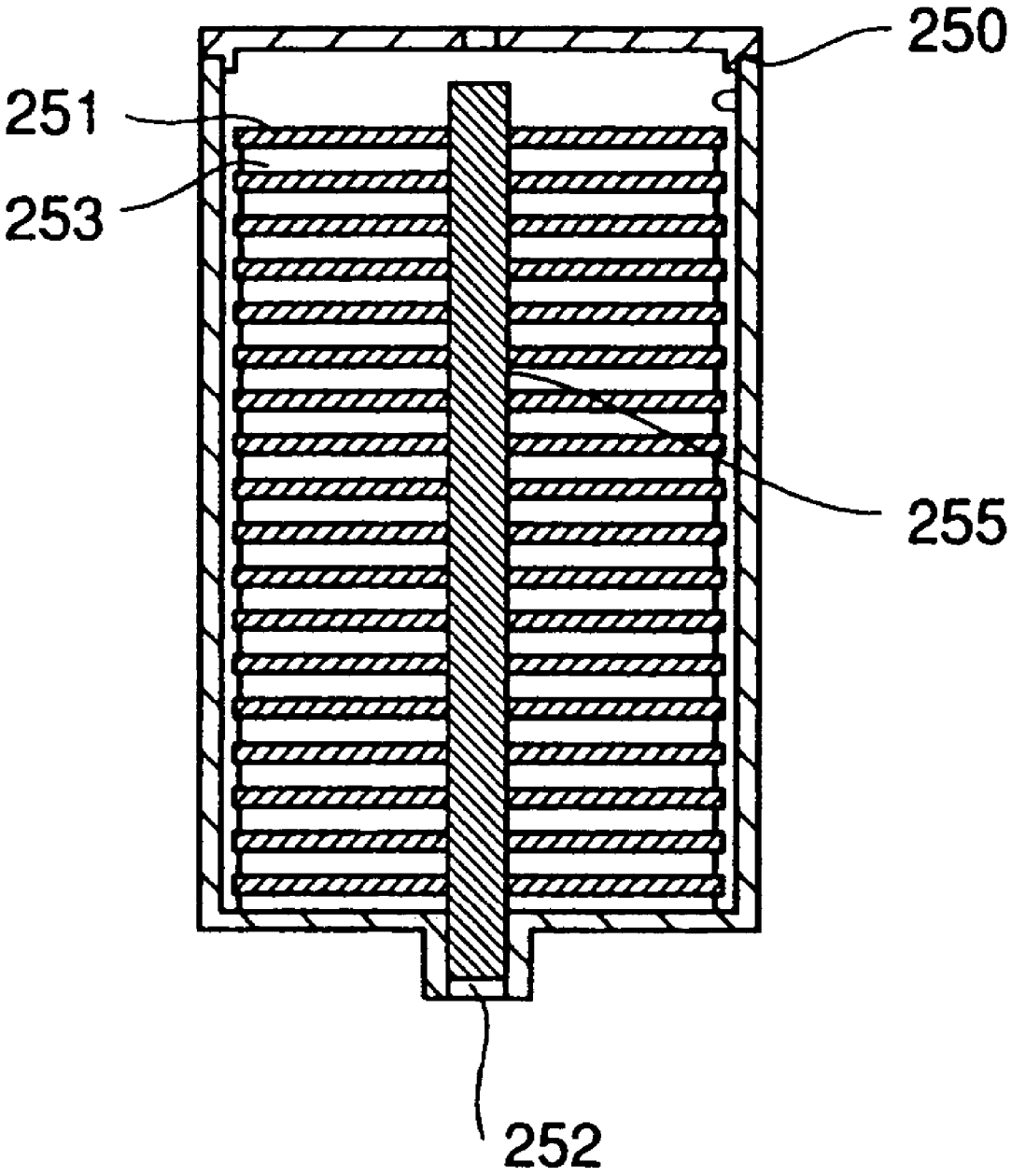
FIG. 22 is a schematic view for explaining the structure of a conventional multilayered-capillary-force-scheme ink reservoir structure.

Each thin body 181 is formed of a plate material to have the substantially wave shape, as shown in FIG. 18, and is arranged to form a wave shape in the horizontal direction. The thin bodies 181 are arranged such that the recesses and projections of their wave shape coincide with each other, so that a wave shaped ink reservoir is formed.

In this manner, when the thin bodies 181 form wave shapes, the mechanical strength in the longitudinal direction perpendicular to the wave direction increases particularly. Hence, even when the thin bodies 181 are formed very thin, they ensure good shapes. As a result, with the thin bodies 181, the space in the ink reservoir can be increased by increasing the number of thin bodies 181 to be disposed in the housing, thereby increasing the ink reservoir efficiency.

As described above, the reservoir ink tank provided to the printer has an ink reservoir which has a plurality of thin bodies provided at gaps, and a liquid guide portion which is provided at a gap between one end of the ink reservoir and the inner wall of the housing so that the capillary force in the vicinity of the ink supply port is larger than that of the ink reservoir. Hence, while the reservoir ink tank can be manufactured at a comparatively low cost, it ensures chemical stability against the ink, and generates a negative pressure with a low channel resistance regardless of a difference in posture of the reservoir ink tank, so that the ink can be supplied stably. Therefore, with this printer, the printing quality of the printing medium S can be improved at a low cost.

The ink reservoir tank according to the present invention is not limited to the arrangements described above as far as a plurality of thin bodies are provided in the ink reservoir and an ink guide portion is provided on the lower end of the thin bodies. For example, the arrangements shown in FIGS. 3 and 8 can naturally be employed.

The present invention can obtain an excellent effect in an inkjet scheme liquid discharge head, head cartridge, or printer which has an energy generating means (e.g., an electrothermal transducer, a laser beam, or the like) for generating a heat energy as an energy to be utilized to cause liquid discharge and which induces a state change of the liquid with the heat energy. In other words, according to the ink-jet scheme, an increase in printing density and quality can be achieved.

As the representative arrangement or principle, the basic principle disclosed in U.S. Pat. No. 4,723,129 or U.S. Pat. No. 4,740,796 is preferably used. This scheme can be applied to either a so-called on-demand type or continuous type printer. This scheme is especially effective to an on-demand type printer because when at least one drive signal corresponding to print information and instructing a rapid increase in temperature beyond film boiling temperature is applied to an electrothermal transducer arranged in correspondence with a sheet or channel in which a liquid is held, a thermal energy is generated in the electrothermal transducer, film boiling occurs on the plane of thermal action of the printhead, and finally, bubbles can be formed in the liquid corresponding to the drive signal in a one-to-one correspondence. The liquid is discharged from an election port as the bubbles grow or shrink, thereby forming at least one droplet. When this drive signal has a pulse shape, bubbles appropriately immediately grow or shrink. For this reason, the liquid can be discharged in a good response. As the drive signal having a pulse shape, a signal disclosed in U.S. Pat. No. 4,463,359 or U.S. Pat. No. 4,345,262 is suitable.

When conditions described in U.S. Pat. No. 4,313,124 associated with the temperature increasing rate on a plane of thermal action are employed, more satisfactory printing can be performed.

As the arrangement of the printhead, not only a combination of orifices, channels, and electrothermal transducers disclosed in the above specifications (linear or rectangular channel) but also an arrangement disclosed in U.S. Pat. No. 4,558,333 or U.S. Pat. No. 4,459,600 in which the plane of thermal action is placed in a deflected region is also incorporated in the present invention. Alternatively, an arrangement disclosed in Japanese Patent Laid-Open No. 59-123670 in which a common slot is used as the discharge portion of an electrothermal transducer or an arrangement disclosed in Japanese Patent Laid-Open No. 59-138461 in which an opening for absorbing the pressure wave of a thermal energy is made to correspond to a discharge portion may be employed.

As a full-line-type printhead having a length corresponding to the width of a largest printing medium on which the printing apparatus can print, the length may be satisfied by combining a plurality of printheads, as disclosed in the above-described specifications, or an integrally formed printhead may be used.

Not only a cartridge type printhead in which an ink tank is integrated with the printhead itself, as described in the above embodiments, but also an exchangeable chip-type printhead which allows electrical connection to the apparatus main body or ink supply from the apparatus main body may be used.

A restoring means or spare means for the printhead is preferably added to the above-described printing apparatus because printing can be made further stable. More specifically, a capping means, cleaning means, pressurizing or chucking means, or spare heating means comprising an electrothermal transducer or another heating element, or a combination thereof can be used for the printhead. A pre-discharge mode for ejection not for printing can also be effectively used for stable printing.

Regarding the types and number of liquid discharge heads to be mounted, only one liquid discharge head may be provided to correspond to monochrome ink, or a plurality of liquid discharge heads may be provided to correspond to a plurality of ink types having different print colors and densities (lightness's). More specifically, for example, as the print mode of the printer, whether an integral liquid discharge head is used or a plurality of liquid discharge heads are combined, the present invention is very effective not only for a print mode using only a mainstream color such as black, but also for a printer having at least one of a multiple-color print mode using different colors and a full-color print mode in which colors are mixed. In this case, it is effective to discharge a treatment solution (print performance improving solution), which adjusts the print performance of the ink in accordance with the type of the printing medium S or the print mode), from an exclusive or common liquid discharge head to the printing medium S.

Regarding the type of the printer according to the present invention, the printer may be the one used as the image output terminal of an information processing equipment such as a computer. Other than that, the printer may be a copying apparatus combined with a reader or the like, a facsimile apparatus having a signal transmitting/receiving function, a printing equipment, or an etching apparatus. As the printing medium, other than a sheet-type or web-type paper, film, or cloth, or plate-type lumber, leather, stone, resin, glass, or metal, a three-dimensional structure can be employed.

The present invention is not limited to the above embodiments and various changes and modifications can be made within the spirit and scope of the present invention. Therefore, to appraise the public of the scope of the present invention, the following claims are made.

What is claimed is:

1. A liquid reservoir apparatus comprising a storage which stores a liquid, a negative pressure introducing portion which introduces a negative pressure into said storage, a liquid intake portion which takes the liquid into said storage with the negative pressure introduced from said negative pressure introducing portion, a liquid storage chamber which is provided in said storage to hold the liquid stored in said storage, a liquid supply port which is provided to said storage to supply the liquid stored in said storage, a gas/liquid separating member which transmits only a gas therethrough, and negative pressure generating means for drawing air in said storage by suction to effect the negative pressure, wherein a plurality of thin plates are disposed in said liquid storage chamber at predetermined intervals to form a storing portion in which predetermined capillary force is generated, wherein a predetermined gap is formed between said storing portion and an outlet, so as to form a guiding portion in which capillary force is generated, wherein the generated capillary force is stronger than the capillary force of said storing portion, and wherein said guiding portion is formed of part of said thin plates forming said storing portion and an inner wall of said liquid storage chamber.

2. The apparatus according to claim 1, wherein said gas/liquid separating member is provided to said negative pressure introducing portion or at a position corresponding to said negative pressure introducing portion.

3. The apparatus according to claim 1, wherein the inner wall of said liquid storage chamber has a groove, at a position adjacent to said guiding portion.

4. The apparatus according to claim 1, wherein the gaps among said thin plates in said liquid storage chamber gradually increase as the gaps are more distant from said guiding portion.

5. The apparatus according to claim 1, wherein the gaps among said thin plates in said liquid storage chamber fall within a range of 0.05 mm (inclusive) to 0.5 mm (inclusive).

6. The apparatus according to claim 1, wherein the capillary force of said liquid storage chamber falls within a range of 30 Pa (inclusive) to 2,000 Pa (inclusive).

7. The apparatus according to claim 1, wherein said gas/liquid separating member is porous and subjected to a repellent treatment.

8. The apparatus according to claim 1, wherein said gas/liquid separating member is a gas permeable film made of a porous material and subjected to a repellent treatment.

9. The apparatus according to claim 1, wherein said gas/liquid separating member is a gas permeable film made of a porous resin material and subjected to a repellent treatment.

10. A printer comprising a liquid reservoir apparatus according to claim 1, wherein liquid in said liquid reservoir apparatus is ink and wherein the printer prints by discharging the ink through a printhead.

* * * * *